US010683665B2

(12) United States Patent
LeBlang

(10) Patent No.: US 10,683,665 B2
(45) Date of Patent: Jun. 16, 2020

(54) METAL FRAMING COMPONENTS FOR WALL PANELS

(71) Applicant: Dennis LeBlang, La Quinta, CA (US)

(72) Inventor: Dennis LeBlang, La Quinta, CA (US)

( * ) Notice: Subject to any disclaimer, the term of this patent is extended or adjusted under 35 U.S.C. 154(b) by 0 days.

(21) Appl. No.: 15/449,250

(22) Filed: Mar. 3, 2017

(65) Prior Publication Data

US 2019/0242129 A1 Aug. 8, 2019

Related U.S. Application Data

(63) Continuation-in-part of application No. 13/398,243, filed on Feb. 16, 2012, now abandoned, and a continuation-in-part of application No. 12/231,875, filed on Sep. 8, 2008, now Pat. No. 8,176,696, application No. 15/449,250, which is a continuation-in-part of application No. 12/456,707, filed on Jun. 22, 2009, now Pat. No. 8,161,699.

(60) Provisional application No. 61/628,044, filed on Oct. 24, 2011, provisional application No. 61/629,552, filed on Nov. 22, 2011, provisional application No. 62/001,566, filed on May 21, 2014, provisional application No. 62/170,269, filed on Jun. 3, 2015, provisional application No. 62/175,195, filed on Jun.

(Continued)

(51) Int. Cl.

| | |
|---|---|
| ***E04C 3/07*** | (2006.01) |
| ***E04B 1/41*** | (2006.01) |
| ***E04B 2/58*** | (2006.01) |
| *E04B 1/38* | (2006.01) |
| *E04B 1/76* | (2006.01) |

(52) U.S. Cl.

CPC ..... *E04C 3/07* (2013.01); *E04B 1/40* (2013.01); *E04B 2/58* (2013.01); *E04B 1/7608* (2013.01); *E04B 1/7654* (2013.01); *E04B 2001/405* (2013.01)

(58) Field of Classification Search

CPC ..... E04C 3/07; E04B 1/40; E04B 2/58; E04B 1/7608; E04B 1/7654; E04B 2001/405

USPC ..... 52/243, 317, 349, 481.1, 653.1, 654.1, 52/655.1, 667, 696, 712, 703, 710, 711, 52/713, 714, 715

See application file for complete search history.

(56) References Cited

U.S. PATENT DOCUMENTS 1,475,387 A * 11/1923 Holmes ..... E04G 9/06 52/506.1

3,653,172 A * 4/1972 Schwartz ..... E04B 2/763 52/669

(Continued)

OTHER PUBLICATIONS

Simpson Strong-Tie Company Inc., Pleasanton, CA. Title of catalog: BBR & DBR Spacer Bracers dated Jan. 1, 2017.

*Primary Examiner* — William V Gilbert

(57) ABSTRACT

The present invention has various types of horizontal bracing channels, longitudinal spacing-bracing channels, couplings, bracing clips, support channels, hole shapes within the support channels and orientation of the various elements that affect how wall panels are made. The structural insulating core includes the framing members and spacer blocks between the framing members that interlock together by having a structural insulating core of foam spacers with a tongue side and groove side interlocking the foam spacers between vertical metal support channels including the horizontal bracing channels, longitudinal spacing-bracing channels having notches, couplings and bracing clips connecting together.

6 Claims, 33 Drawing Sheets

Related U.S. Application Data

12, 2015, provisional application No. 62/369,041, filed on Jul. 30, 2016.

(56) References Cited

U.S. PATENT DOCUMENTS

| | | | | | |
|---|---|---|---|---|---|
| 5,363,622 | A * | 11/1994 | Sauer | E04B 9/008 | 403/363 |
| 5,784,850 | A * | 7/1998 | Elderson | E04B 2/789 | 403/375 |
| 5,797,233 | A * | 8/1998 | Hascall | E04B 2/766 | 52/481.1 |
| 5,964,071 | A * | 10/1999 | Sato | E04B 2/7457 | 403/316 |
| 6,023,898 | A * | 2/2000 | Josey | E04B 1/2403 | 52/309.5 |
| 6,209,268 | B1 * | 4/2001 | Schmidt | E04B 1/2608 | 52/665 |
| 7,159,369 | B2 * | 1/2007 | Elderson | E04L 32/7457 | 52/481.2 |
| 9,109,361 | B2 * | 8/2015 | Daudet | E04C 3/07 | |
| 2006/0191236 | A1 * | 8/2006 | Surowiecki | E04B 2/763 | 52/481.1 |
| 2017/0191254 | A1 * | 7/2017 | Daudet | E04B 1/40 | |

* cited by examiner

METAL FRAMING COMPONENTS FOR WALL PANELS

This application is a continuation-in-part application of application Ser. No. 13/398,243 filed on Feb. 16, 2012, now abandoned and claims priority on provisional application No. 61/628,044 filed on Oct. 24, 2011 and provisional application No. 61/629,442 U.S. 61/629,552 filed on Nov. 18, 2011, and is a continuation-in-part application of application Ser. No. 12/231,875 filed on Sep. 8, 2008, and is a continuation-in-part application of application Ser. No. 12/456,707, filed on Jun. 22, 2009, now U.S. Pat. No. 8,161,699. The disclosures in said above identified applications are incorporated into this application by reference.

FEDERALLY SPONSORED RESEARCH OR DEVELOPMENT

Not applicable

PARTIES OR JOINT RESEARCH

Not applicable

FIELD OF THE INVENTION

The present invention relates to wall panels having a structural insulating core of foam spacers with a tongue space and a groove space interlocking foam spacers between vertical metal support channels. The foam spacers are wider than the support channels forming an air gap between the support channels and the inner and outer boards. Horizontal bracing channels or longitudinal spacing-bracing member fit between the horizontal tongue of one foam spacer and the trough within other foam spacers connecting the foam spacers, vertical support channels and horizontal bracing channels together. Various types of horizontal bracing channels, longitudinal spacing-bracing member with notches, support channels, hole shapes within the support channels and orientation of the various elements and the shape of the foam spacers changes affect how the structural insulating core wall is used including the type of material the foam spacers are made of.

The present invention relates to an improved wall system where the structural insulating core uses various wall forming structures and spacer blocks interconnecting between each other. Another aspect of the invention is the interlocking notches in the longitudinal spacing-bracing members connecting the support channels and the coupling connection and electrical chases incorporated into the wall forming structure.

BACKGROUND OF THE INVENTION

Exterior metal framing has always been difficult to insulate because of the configuration of the support channels like a C channel. The lip and flange of the C channel protrudes from the web making it difficult to insulate. When horizontal bracing channels are installed between support channels for additional strength, insulation became even more difficult to install as well as form a good insulated wall.

The metal framing was installed first, then a rigid insulation was installed on the exterior, mechanicals were then added and a fibre glass insulation was installed between the support channels. Later insulation was blown into the wall cavity that is between the support channels after the sheathing was installed on the exterior.

Closed cell rigid insulation has been increasing in popularity, however the solutions has been to mold the closed cell insulation into the support channels. In addition, closed cell rigid insulation has been cut into panels where several support channels slide into the rigid insulation panel from the top of the rigid insulation in order to install the support channels. The closed cell rigid insulation solutions are usually installed in a manufacturing plant rather that at the job site.

The horizontal bracing channels within the wall forming structure is generally provided by installing bridging members which tie the support channels together. These bridging members may be attached on the outside of the flanges of the support channels or may be internal bridging members installed through openings provided in the web of the support channels. None of the bridging members used today have a limited function and do not provide a solution for interacting with rigid insulation between support channels and the holes the internal bridging members pass through.

DESCRIPTION OF PRIOR ART

There are many different aspects to the invention which involves many different subjects which are noted below.

Horizontal Bracing Channels

Rice in U.S. Pat. No. 8,011,160 uses a bracket to connect the horizontal bracing channels to the vertical C channels. Poliquin in U.S. Pat. No. 6,199,336 uses a tab to hold the horizontal bracing channel to the vertical support channel. diGirolamo in U.S. Pat. Nos. 7,596,921, 7,596,921, 7,836,657 & U.S. Pat. No. 6,701,689 shows various horizontal bracing channels, however the U channel facing downward with groove is shown in the pending patent used in conjunction with the foam spacers. Dietrich Industries uses Brunt in U.S. Pat. No. 7,017,310, Elderson in U.S. Pat. No. 6,920,734 & U.S. Pat. Nos. 6,708,460, 7,168,219, 7,159,369 and Collins in U.S. Pat. No. 6,694,695 to disclose to show a V shaped horizontal bracing channel between the vertical support channels of a metal framing system. The V shaped horizontal bracing channel is always pointing upward and is not used in conjunction with a spacer block. The V shaped is used in the pending patent along with the spacer block and incorporating various hole configurations. Hughes in U.S. Pat. No. 6,164,928 forms a horizontal bracing channel that does not reflect the pending patent.

Channel Indentations

Rice in U.S. Pat. No. 7,849,640 uses an indentation in the support channel. Rice in U.S. Pat. No. 7,849,640 has a base channel and a support channel connection, but does not reflect how the channel indentation is applied in the pending patent. In U.S. Pat. No. 7,836,657 by diGirolamo uses channel indentations to explain a horizontal bridging member, but does not relate the indentations to spacer blocks. Meyer in U.S. Pat. No. 5,157,883 uses an indentation in the metal channels to describe a clip.

Holes in Vertical Channels

Edmondson in U.S. Pat. No. 7,866,112 uses a punched hole with flanges to form the holes in the vertical channels of a metal framed wall. Bodnar in U.S. Pat. No. 4,793,113 show large holes with bent flaps does not reflect the pending patent.

SIP

Structural insulated panels known as SIP's are typically made using rigid insulation in the middle with plywood on both sides and wood blocking or metal connectors are installed in the middle connecting the two panels together.

Porter has developed many SIP patents using metal components including U.S. Pat. Nos. 5,497,589, 5,628,158, 5,842,314, 6,269,608, 6,308,491, and 6,408,594 as well as Babcock U.S. Pat. No. 6,256,960, Brown U.S. Pat. No. 6,564,521 and Kligler U.S. Pat. No. 6,584,742 of which Babcock shows a metal channel between two panels to interlock adjacent panels. In U.S. Pat. No. 5,638,651 uses metal channels at interior but does not have a thermal break on the metal channels. Porter shows 5 more patents using wood and one more U.S. Pat. No. 5,950,389 using splines to interlock panels. Frost in U.S. Pat. No. 6,568,138 uses holes in base plate for predetermine metal stud spacing.

Panel Construction

In U.S. Pat. No. 5,638,651 filed Jun. 21, 1996 by Ford uses an interlocking panel system where two U channels interlocks with an OSB board and the metal channel to form a building panel. In U.S. Pat. No. 6,701,684 filed Jun. 26, 2002 by Stadler uses vertical back to back U metal channels in a foam panel and a cementitious coating over the foam to form a wall. In U.S. Pat. No. 6,880,304 filed Sep. 9, 2003 by Budge, uses vertical slotted frames to support a foamed wall assembly.

SUMMARY OF THE INVENTION

The present invention relates to an improved wall system where a structural insulating core wall uses various wall forming structures with metal framing components and spacer blocks interconnecting between each other. The various sizes and shape of support channels, horizontal bracing channels, holes in the web of the support channels and base plates all alter the shape of the spacer blocks and the shape of the horizontal bracing channels. The metal framing components can be altered by changing the orientation of the hole, and shape, width, size, ledges or rim size and angles of the holes in the support channels, horizontal bracing channels also change the shape of the spacer blocks and the type of material used to form the spacer blocks. The spacer blocks have vertical and horizontal interlocking tongue and groove connections that connect between the wall forming structure and the spacer blocks. The spacer blocks can cover the flanges of the support channels or just protrude beyond the support channels to form a thermal break. The horizontal bracing channels with the spacer blocks can be oriented face up or face down The metal framing aspect of the invention describes horizontal bracing channels that fit through the holes of the metal framing whether it passing through the wall or flooring support members. The support members come in different widths usually in 2½" to 12' and shaped typically as a C or U channel usually with holes in the web from 2½, 1" and ¾", 2" and triangular holes. There are U shapes, reverse lip shapes where the longitudinal walls or flange ends or lip ends having notches Another aspect of the invention is an electrical chase installed within the foam spacers and horizontal bracing channels of the structural insulating core. The horizontal bracing channel can be oriented so the U or V shape of the horizontal bracing channel is oriented upward or downward without lips or with lips having notches causing the trough within the spacer channel or the electric chase to be above or below the horizontal bracing channels and whether the horizontal bracing channel fits within the trough or is larger than the trough within the spacer blocks. When the horizontal bracing channel is larger than the hole in the web of the support channels, a notch is added to the lip of the horizontal bracing channels to secure the channels together by stacking: the lips together, the webs together or inserting the channel configurations together orientated either upward or downward. When two horizontal bracing channels are stacked with the lips together one horizontal bracing channel is reversed, the reversed horizontal bracing channel becomes a cover over the other horizontal bracing channel and the lip notches and/or flange notches are secured into the hole side edges.

Another aspect of the invention is the holes in the web of the support channel have many different sizes and various configurations to allow different shape horizontal bracing channels and the lip notches to align with the holes in the web of the support channels. Additional notches can be added on the horizontal bracing channels to secure the support channels and the connections between the foam spacers and adjoining support channels. There are many different horizontal bracing channels shapes that are presently being manufactured today that will add additional strength by increasing the number of bends, grooves, striations and ribs in the web, longitudinal walls and lips extending from the free edges of the longitudinal walls. The lips of the longitudinal spacing-bracing member have notches extending inward from the free side edges, engaging the side planes of the opening in the web of the support member where the back edges of the notches become the heels of the notches engaging both side edges of the opening. There are many alternative solutions that have been submitted in additional pending patent applications.

Another aspect of the invention is that now brackets that are short vertical support channels and short horizontal bracing channels can be connected together using notches in the horizontal bracing channels and indentations in the vertical support channels securing the foam spacers together for a strong connection.

One embodiment of the present invention is directed to a longitudinal spacing-bracing member comprising a web, a portion of the web lying in a plane, the web having first and second opposing sides, first and second longitudinal walls having a connection side and a free side, the connection side of the first longitudinal wall connected to first side of the web and extending away from the plane of the web, the connection side of the second longitudinal wall connected to second side of the web and extending away from the web, the web and the first and second longitudinal walls forming a longitudinal channel running the length of the longitudinal spacing-bracing member, each of the longitudinal walls having a longitudinal lip running the length of the each longitudinal wall, the lips extending outwardly from the longitudinal walls and away from each other, the lip of each longitudinal wall joined to the free side of each wall, the lips are notched inward from their free edge the longitudinal spacing-bracing member adapted to be received in holes in the web of at least two neighboring vertical supports of wall framing. The width of lip notches at their open ends can have angled edges the entire width of the lip notches or only the open end portions of the lip notches for most of its length into the lips.

The first and second longitudinal walls extend from the longitudinal side edges at the web of the longitudinal interlocking spacing-bracing member extend outward and away either at an angle or perpendicular to the web.

The holes in the support member vary in width and the length of the notches are the result of the hole width. Depending on the shape of the longitudinal spacing-bracing member the width of the lip, flange and web will vary as the back edge of the notch is fixed by the width of the hole in the support channel making a long continuous notch length when a small hole is used in the support channel.

Another embodiment of the present invention is directed to a longitudinal spacing-bracing member comprising a web, a portion of the web lying in a plane, the web having first and second opposing sides, first and second longitudinal walls having a connection side and a free side, the connection side of the first longitudinal wall connected to first side of the web and extending away from the plane of the web, the connection side of the second longitudinal wall connected to second side of the web and extending away from the web, each of the longitudinal walls having a longitudinal lip running the length of the each longitudinal wall, the lips extending outwardly from the longitudinal walls and away from each other, the lip of each longitudinal wall joined to the free side of each wall, the web and longitudinal walls are notched from their point of joinder inwardly into the web and outwardly into the longitudinal walls the notches in the web being continuous to the notches in the longitudinal walls engaging the side planes of the opening adapted to be received the web and longitudinal side wall notches of at least two neighboring vertical supports of wall framing.

The lips are notched inward from their free edge engaging the side walls of the hole in the support member forming a continuous notch with the back edge of the notch to the side edge of the hole.

In another preferred embodiment the notches in the web are aligned with the side edges of the opening in the crossing member of the longitudinal spacing-bracing member and the notches in the longitudinal walls are aligned to the plane of the opening of the crossing member.

Preferably the first and second longitudinal walls extend from the web of the longitudinal spacing-bracing member away from to the plane of the web.

Alternatively the first and second longitudinal walls extend away from each other and each wall extends at an angle from the web The above channel shaped longitudinal spacing-bracing members can have one or more longitudinal depressions from the interior and exterior side of the web, flanges or lips running the length of the longitudinal spacing-bracing members.

Preferably the lips of the above longitudinal spacing-bracing members can lie in a common or angular plane the plane of the web.

In still another embodiment, the longitudinal spacing-bracing member comprising a longitudinal V-shape body in cross section having first and second longitudinal walls joined at the vertex of the V-shaped body, the vertex of the V-shaped body lying on the outside of the longitudinal spacing-bracing member, each of the first and second longitudinal walls lying in separate non-parallel planes, the planes intersecting, the angle between the first and second longitudinal wall being from about 60 to about 150 degrees, each of the longitudinal walls having a longitudinal lip running the length of the each longitudinal wall, the lips joined at the side edge of each wall spaced apart from the vertex of the longitudinal spacing-bracing member, the lips extending outwardly from the longitudinal walls and away from each other, the longitudinal spacing-bracing member adapted to be received in holes in the web of at least two neighboring vertical supports of wall framing. The width of each notch at its open end in the lip is larger than the width of the notch for most of its length into the lip, when a flare edge is used.

Preferably the vertex of the V-shaped longitudinal spacing-bracing member has two angled sides with a continuous notch at the vertex each notch spaced longitudinally apart from its neighboring notch by a first distance.

In one preferred embodiment of the V-shaped longitudinal spacing-bracing member according to claim 16 wherein the free side edge of each lip has two or more notches, each notch spaced longitudinally apart from its neighboring notch, each set of notches in both lips being aligned laterally to the longitudinal axis of the longitudinal spacing-bracing member.

In another embodiment of the V-shaped longitudinal spacing-bracing member each of the first and second longitudinal walls has one or more longitudinal depressions from the interior and exterior side running the length of the longitudinal spacing-bracing member.

The above longitudinal spacing-bracing member can be secured at one of its ends to the end of a like second longitudinal spacing-bracing member such that the longitudinal axis of the second longitudinal spacing-bracing member is aligned with the longitudinal axis of the first longitudinal spacing-bracing member with the end of the first longitudinal spacing-bracing member in close proximity to an end of second longitudinal spacing-bracing member, the first and second longitudinal spacing-bracing members secured to one another by stacking the webs together, by stacking the lips together, by changing the width of one of the spacing-bracing member to having a wider web or a smaller web or by installing bracket having a U-shape or a reverse lip channel with notches over or under two adjacent longitudinal spacing-bracing members.

Another aspect in the invention is the grooves provide additional strength interlocking the longitudinal spacing-bracing member to the holes in the support channel and the use of couplings to connect the longitudinal spacing-bracing members together.

Another aspect in the invention is the multi-plane bracket that fits into the horizontal bracing channels so that the various types of notches engages the side edges of the holes in the support members connecting the support members, multi-plane bracket and horizontal bracing channels together. Another aspect of the invention is the multi-plane bracket is installed into the hole with the lip notches engaging the side edges and the horizontal bracing member fits into the multi-plane bracket. The multi-plane bracket can fit over or under the horizontal bracing channel no matter if the horizontal bracing member is oriented upward or downward.

Since this application I have submitted many additional patent applications where other types of notches have been developed and the shape and orientation of the longitudinal spacing-bracing members has varied as well as the size and shape of the hole. The lip notches engaging the hole side edges, notches in the web and side walls creates the understanding of connecting support members together without using fasteners and sets the pattern to expand the technology into additional patent applications.

DESCRIPTION OF THE PREFERRED EMBODIMENTS

Figure 1:
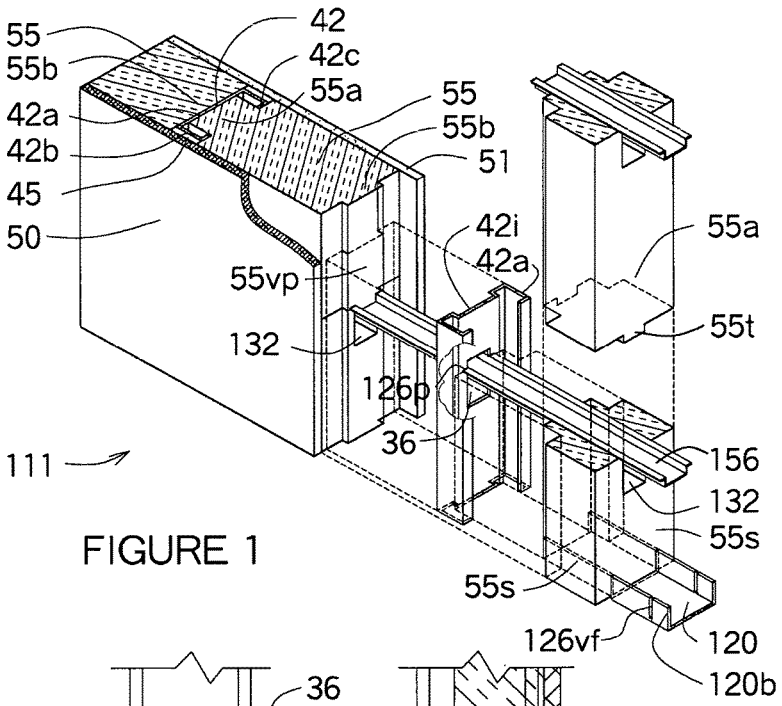
FIG. 1 shows an isometric view of the structural insulating wall where the foam spacers are wider than the support channels with a horizontal bracing channel or more specifically a longitudinal spacing-bracing member have a groove in the lip fitting into a trough of the foam spacers connecting to the support channels together along with the base plate connections to the foam spacers and support channels. The inner and outer boards form a thermal break gap, i.e. air space between the elements. The support channel shows an indentation in the web and the foam spacers have a vertical projection.

FIG. 1 shows an isometric drawing of the structural insulating core 111 where the left side shows the wall assembled and the right side shows the various wall components separated. The right side shows the support channel as a C channel 42 with the longitudinal spacing-bracing channel shown as a horizontal reverse lip channel 156 passing through the hole 36 in the web 42*a* of the C channel 42. The horizontal reverse lip channel 156 has a lip_notch 126*p* in the lip 156*c* as shown in the enlarged view of FIGS. 18 & 80 that secures the horizontal reverse lip channel 156 to the web 42*a* of the support channel. The lip 156*c* rests on top of the trough 132 formed in the middle of the foam spacer 55 and the flanges 156*b* fit into the trough 132 which is below the horizontal reverse lip channel 156 forming an electrical/mechanical chase within the trough 132. Another foam spacer 55 is shown above the horizontal reverse lip channel 156 where a horizontal tongue 55*t* of the foam spacer 55 fits between the flanges 156*b* and against the web 156*a* of the horizontal reverse lip channel 156. All the foam spacers 55 within FIG. 1 are shown deeper than the length of the web 42*a* of the support channel shown as a C channel 42 and extend beyond the flanges 42*b*. The foam spacers 55 all have a tongue shape 55*a* that fits between the lips 42*c* and abut the webs 42*a* of the C channels 42. The opposite side of the spacer block is referred to the groove side where a vertical projection 55*vp* is shown. The C channel 42 on the right has an indentation 42*i* in the web 42*a* so the vertical projection 55*vp* can fit into the indentation 42*i* of the C channel 42. The base plate 120 passes through the short foam spacer 55*s* and the base plate 120 has a vertical-flange notch 126*vf* in the flange 120*b* where the web 42*b* of the C channel 42 slides into the vertical-flange notch 126*vf*. The left side of FIG. 1 shows the wall panel consisting of the structural insulating core 111 assembled together with the rigid board 50 and rigid insulation 51 are the inner and outer rigid boards that define the outer surfaces. Since the foam spacers 55 extends beyond the flanges 42*b* of the C channel 42 a gap 45 is shown on both sides of the C channel 42 when the rigid board 50 and rigid insulation 51 is installed over the structural insulating core 111. Neither the rigid board 50 and rigid insulation 51 touches the C channel 42 leaving gap 45 function as a thermal break and therefore heat or cold are not transmitted directly through the C channel 42 also shown in the enlargement FIG. 18. The C channel 42 shown on the left does not have an indentation 42*i* in the web 42*a* of the C channel 42.

Figure 2:
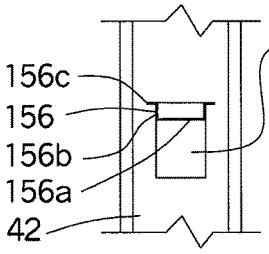
FIG. 2 shows a wall section of the longitudinal spacing-bracing member shown as a horizontal reverse lip channel connecting a hole in the support channel where the hole is below the horizontal reverse lip channel.
Figure 3:
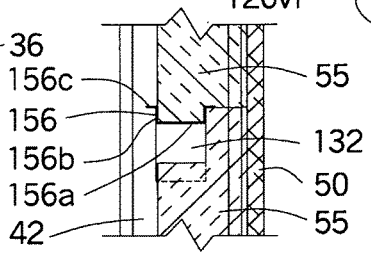
FIG. 3 shows the wall section of FIG. 2 with the trough below the horizontal reverse lip channel forming an electric/mechanical chase in a half wall.
Figure 4:
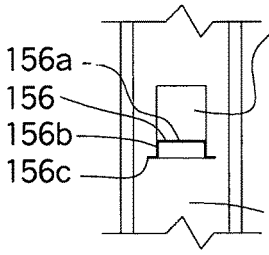
FIG. 4 shows a wall section of the horizontal reverse lip channel upside down and the hole in the support channel is above the horizontal reverse lip channel.
Figure 5:
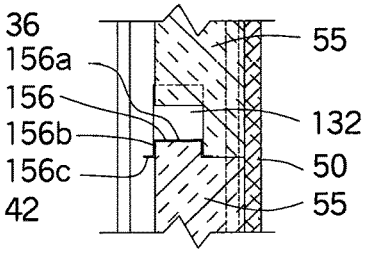
FIG. 5 shows a wall section of FIG. 4 with the horizontal reverse lip channel upside down and the trough is above the horizontal reverse lip channel.
Figure 9:
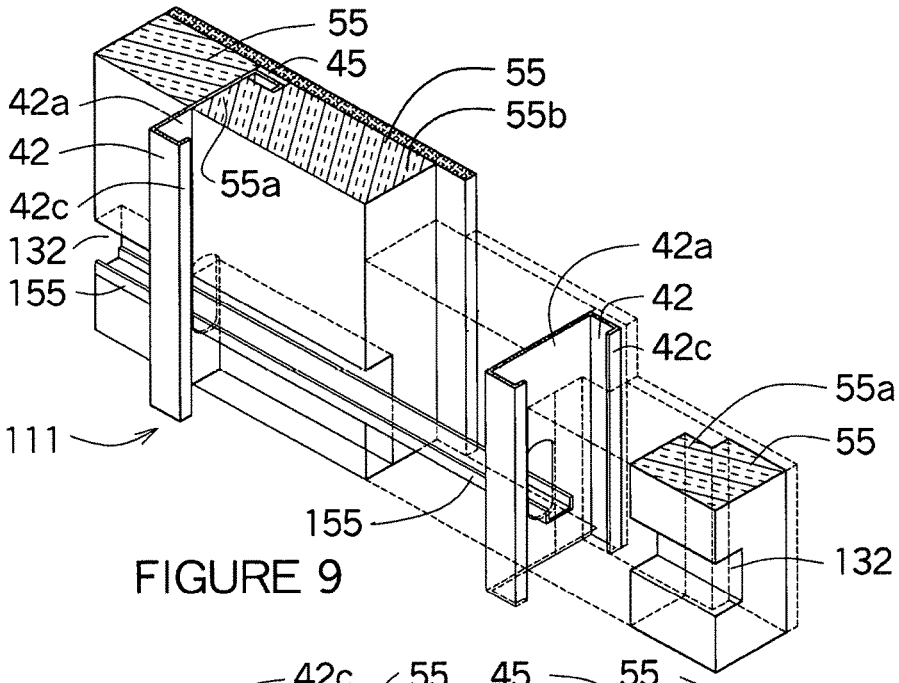
FIG. 9 is an isometric view of a half wall using the foam spacers with an exposed trough.
Figure 10:
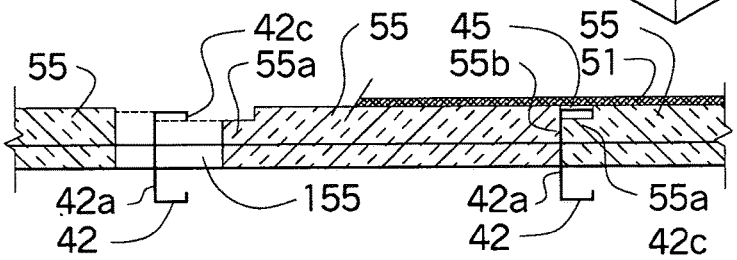
FIG. 10 is a plan view of FIG. 9.

FIGS. 2-5 shows the longitudinal spacing-bracing member as a horizontal reverse lip channel 156 and used where the foam spacers 55 are not the full thickness of the C channel 42 as shown in FIGS. 9 & 10. FIGS. 2 & 3 show the longitudinal spacing-bracing member as a horizontal reverse lip channel 156 also shown in FIG. 80 where the flanges 156*b* and the web 156*a* form a U shape with the interior side facing up which is contrary to FIGS. 4 & 5 where the exterior side is facing upward with the web 156*a* is above and the flanges 156*b* and lip 156*c* are below or installed in reverse of FIGS. 2 & 3. When installing the horizontal reverse lip channel 156 with the interior side has U shape facing up, the hole 36 is below the exterior side of the horizontal reverse lip channel 156 and therefore the trough 132 is also below the horizontal reverse lip channel 156. Since the foam spacer 55 is not the full thickness of the C channel 42, the trough 132 is open on one side leaving the electric chase be exposed on one side. The foam spacer 55 extends past the C channel 42 as shown in FIG. 1 and the rigid board 50 is also installed on the structural insulating core 111. As explained above, the horizontal reverse lip channel 156 the interior side is facing downward leaving the hole 36 above the horizontal reverse lip channel 156. When the interior side of the horizontal reverse lip channel 156 is facing upward the horizontal tongue 55*t* is inserted into the U shape from the foam spacer 55 above, while if the U shape is facing downward the horizontal tongue 55*t* is inserted into the U shape from the foam spacer 55 below.

Figure 6:
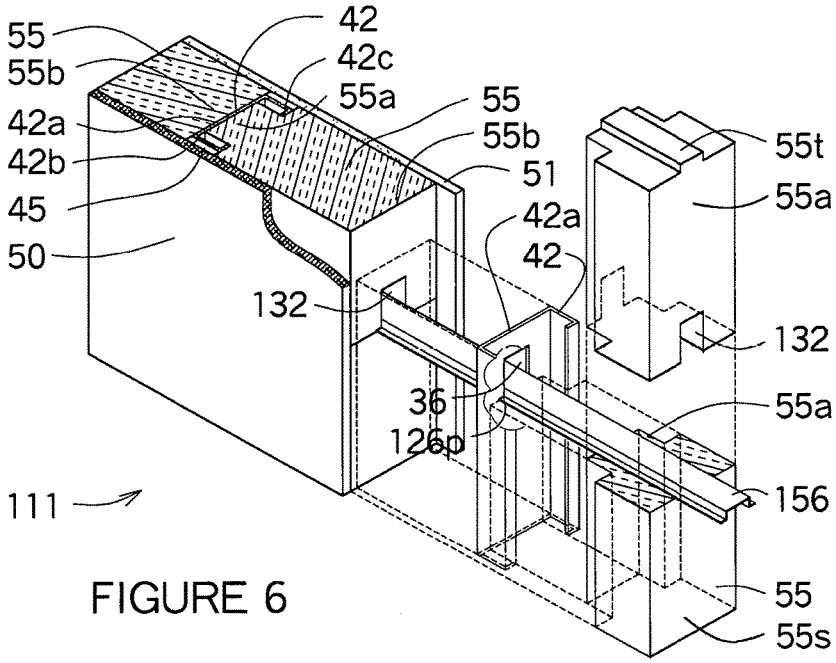
FIG. 6 shows an isometric view of the wall system using a face down horizontal reverse lip channel and the trough is above the horizontal reverse lip channel.
Figure 11:
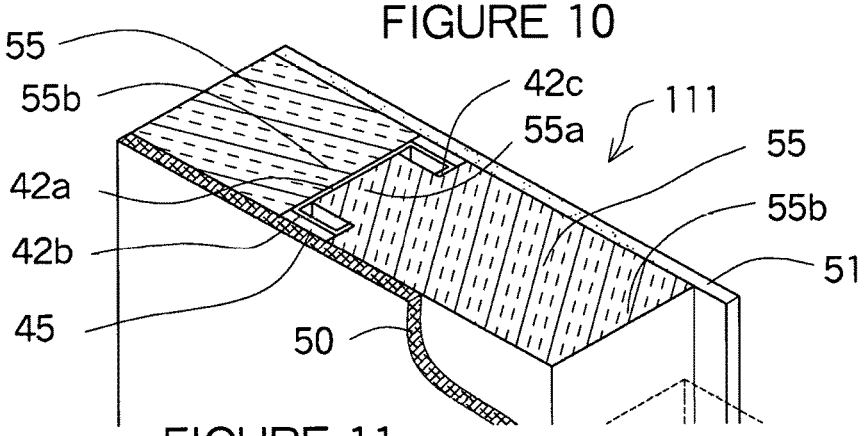
FIG. 11 is an isometric view of an enlargement of structural insulating wall with the inner and outer boards shown in FIG. 1

FIG. 6 is similar to FIG. 1 except the longitudinal spacing-bracing member shown as a horizontal reverse lip channel 156 is turned upside down, that is the exterior side of the web 156*a* is on top with the lips 156*c* extending downward to the bottom edge of the hole 36 in the web 156*a*. The foam spacer 55 is shown separated from the short foam spacer 55*s* below. When the foam spacer 55 is placed onto the short foam spacer 55*s*, the horizontal tongue 55*t* is on the top of the foam spacer 55 so the horizontal tongue 55*t* can fit into the U-shape and between the flanges 156*b* of the horizontal reverse lip channel 156 and the lips 156*c* rest onto the short foam spacer 55*s* below. The foam spacer 55 above the horizontal reverse lip channel 156 has a trough 132 that is equal to the web 156*a* of the horizontal reverse lip channel 156*a* and the flanges 156*b* fits into the trough 132 making a tight connection between the two and the remainder of the trough 132 above the horizontal reverse lip channel 156 is used as an electrical/utility chase. When passing through the web 42*a* of the C channel 42, the lip notches 126*p* in the lip 156*c* fit into the web 42*a* at the side edges of the hole in the support channels to form the structural insulating core 111. The foam spacer 55 is also wider than the support channel and extends beyond the flanges 42*b* of the C channel 42 as shown in FIG. 11. The assembled structural insulating core 111 is shown on the left side of the isometric drawing and the rigid board 50 and rigid insulation 51 is shown attached to the structural insulating core 111. Fasteners 37 can be installed through the rigid board 50 and rigid insulation 51 directly into the flanges 42*b* of the C channel 42 leaving a gap 45 between them. If the rigid board 50 and rigid insulation 51 was glued to the structural insulating core, the assembly would be consider a SIP known as a Structural Insulated Panel and could be manufactured into various lengths and heights.

Figure 7:
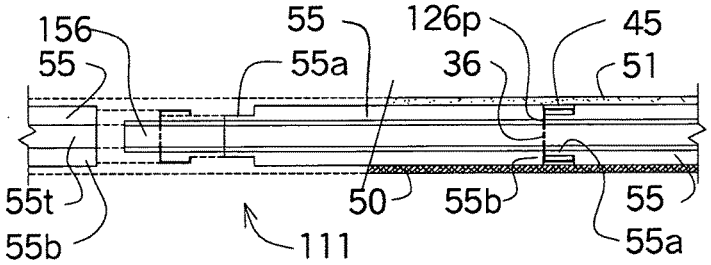
FIG. 7 is a plan view of FIG. 6.

FIG. 7 is a plan view of FIG. 6 which shows the relationship of the longitudinal spacing-bracing member shown as the horizontal reverse lip channel 156. The lip notch 126*p* is shown fitting between the web 42*a* of the C channel at the hole 36 therefore the lip notch 126*p* locks in the adjacent support channels shown as C channels 42. Since the horizontal reverse lip channel 156 is used, the foam spacer 55 has the horizontal tongue 55*t* on top of the foam spacer 55 so the horizontal tongue 55*t* can fit between the flanges 42*b* and against the web 42*a*. The plan view also show the foam spacer 55 interlocking into the C channel 42 and how the foam spacers 55 create the gap 45 when the foam spacers 55 fit into the C channel 42.

Figure 8:
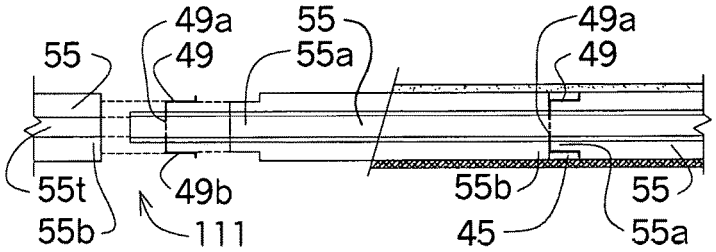
FIG. 8 is a plan view of the reverse lip channel used as a support channel.

FIG. 8 shows the same plan configuration as FIG. 7 except a reverse lip support channel 49 is used as the support channel between the foam spacers 55. Since the lip 49*c* extends outward away from the web 49*a* or in an opposite direction of a C channel 42 shown in FIG. 7. The foam spacer 55 is wider than the depth of the reverse lip support channel 49 and slightly longer than the lip 49*c* so the rigid board 50 and rigid insulation 51 do not touch the reverse lip support channel 49. The web 49*a* is perpendicular to the flanges 49*b* so the rigid board 50 and rigid insulation 51 so fasteners can be attached to the flanges 49*b*.

Figure 31:
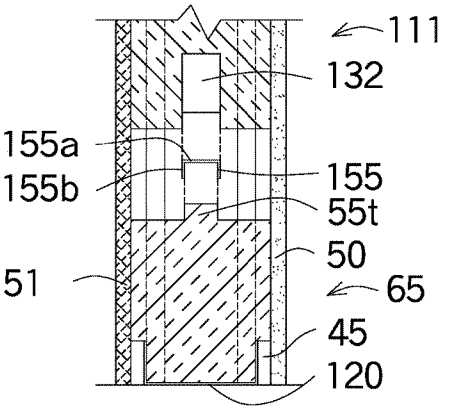
FIG. 31 shows a wall section with the horizontal U channel facing downward.
Figure 70:
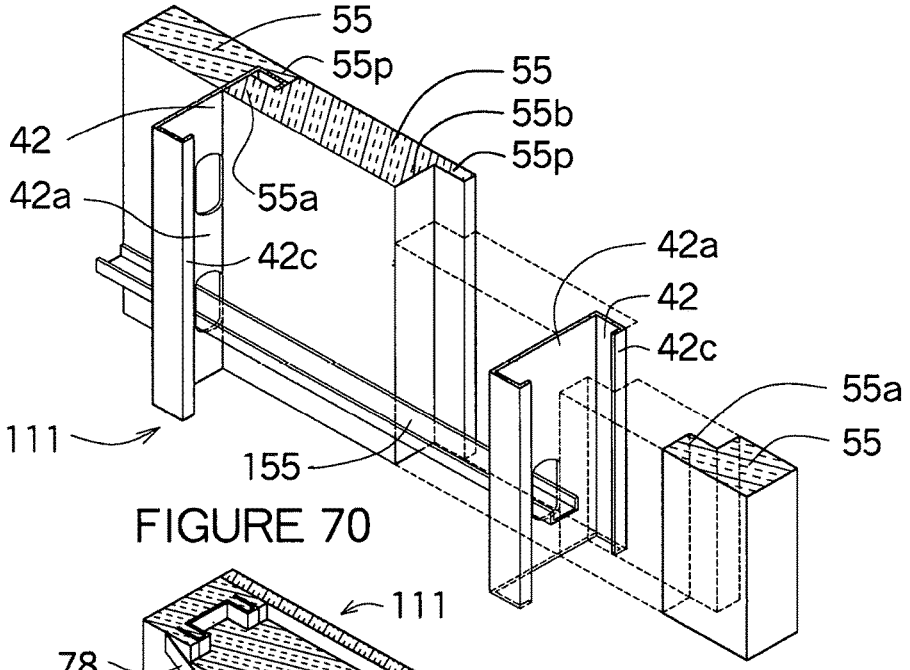
FIG. 70 shows an isometric view of a thinner tongue and groove foam spacer with a C channel wall structure.
Figure 72:
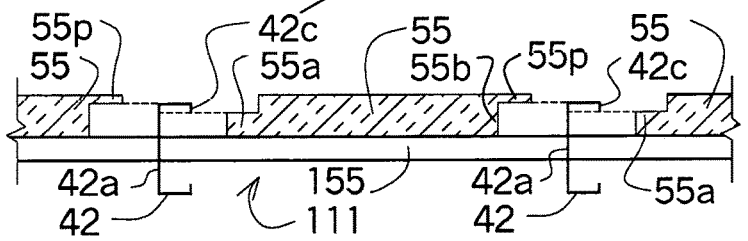
FIG. 72 is a plan view showing the thinner tongue and groove foam spacer using a C channel as the structure component of the wall.

FIG. 9 shows an isometric drawing and FIG. 10 a plan view of a half wall where the foam spacers 55 do not extend the full width of the support channels shown as a C channel 42. The previously mentioned longitudinal spacing-bracing member showed lip notches 126*p* used to secure the member to the edges of the hole 36, however in FIG. 9 the horizontal U channel 155 passes through the holes 36 in the web 42*a*. The foam spacer 55 has a tongue shape 55*a* that abuts the web 42*a* and the lip 42*c* of the C channel 42. The width of the spacer block shown as foam spacers 55 extends over the hole 36 in the support channel and the other side extends past the flange 42*b*. The opposite end of the foam spacer 55 shows the groove shape 55*b* abutting the web 42*a* of the adjacent support channel and also extend over the hole 36 and past the flange 42*b*. The foam spacers 55 in FIG. 11 do not extend over the flanges on both sides of the C channel 42 form, but form gaps 45 when the rigid board 50 extends over the foam spacers 55. The exposed C channels 42 show the horizontally oriented trough 132 above the horizontal bracing channel shown as a horizontal U channel 155 open to the interior for easy access to the horizontally oriented trough 132 similar to FIGS. 70 & 72. The different configuration of the horizontal U channel 155 is shown in FIG. 31 which can be used in FIG. 9 to connect two spacer blocks together. By reversing the horizontal U channel 155 as shown in FIG. 31 the flanges 155*b* are shown below the web 155*a* which allows the horizontal tongue 55*t* from the foam spacer 55 below to interlock into the horizontal U channel 155.

FIG. 11 shows an enlargement of the structural insulating core 111 at the gap 45 shown in FIGS. 1, 6 & 9. The wall sections in FIGS. 2-8 shows the longitudinal spacing bracing channel as a horizontal reverse lip channel 156, but both the horizontal bracing channels have similar configurations.

Figure 12:
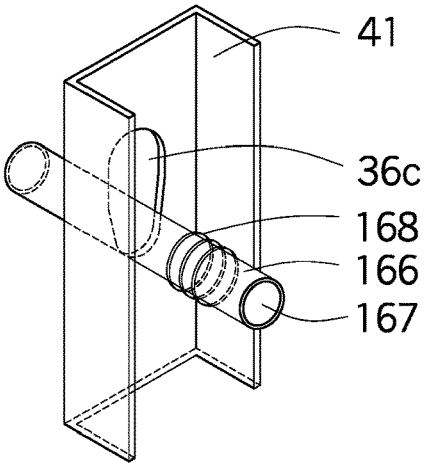
FIG. 12 show an isometric view of a horizontal bracing channels as a round rod or a tube passing through the round hole in the support channel.
Figure 13:
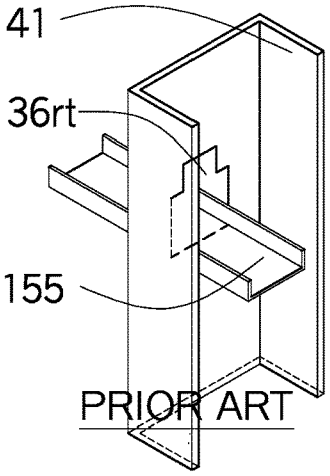
FIG. 13 shows an isometric view of a U channel as the support channel with the horizontal U channel as the horizontal bracing channel.
Figure 14:
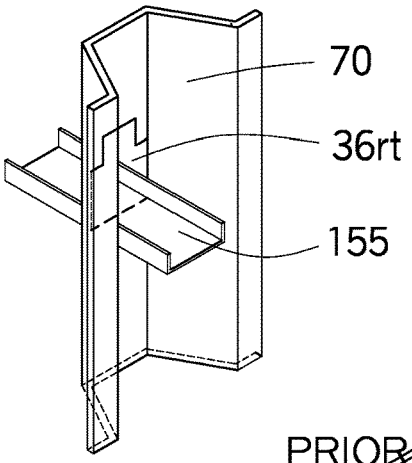
FIG. 14 shows an isometric view of a hat channel as the support channel with a rectilinear hole and a horizontal U channel.
Figure 15:
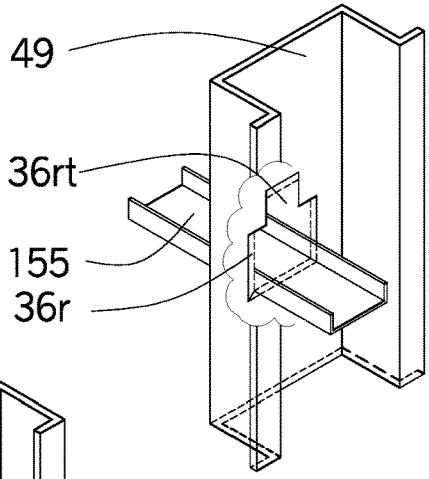
FIG. 15 shows an isometric view of a reverse lip channel as the support channel, a rectilinear hole with a ledge around a portion of the hole with a horizontal U channel passing through the hole.
Figure 16:
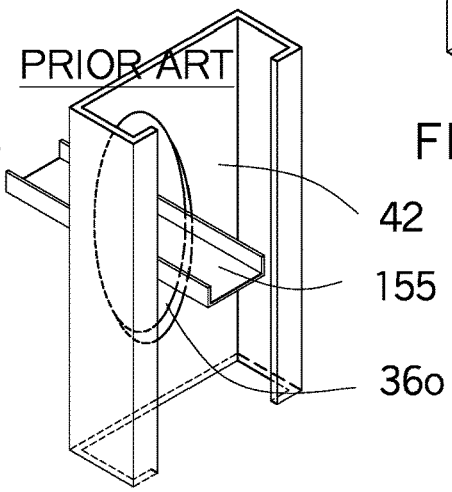
FIG. 16 shows an isometric view of a C channel with an oval hole and the horizontal U channel.

FIGS. 12-16 different support channels and different horizontal bracing channels. FIGS. 12 & 13 show U channels 41 as the support channel and FIG. 14 a hat channel 70, FIG. 15 a reverse lip support channel 49 and FIG. 16 a C channel 42. All the various support channels all serve the same function of supporting a wall panel. The holes 36 in the various support channels have different shapes to accommodate the shapes and function of the horizontal bracing channels. FIG. 12 shows a round hole 36*c* at the bottom of the hole 36 to accommodate the round rod 166 or a hollow tube 167. Both the round rod 166 and hollow tube 167 are shown having small ridges 168 that would engage the sides of the rectilinear hole 36*rt*. FIG. 13-15 show a rectilinear hole 36*rt* where the horizontal bracing channels are a horizontal U channel 155 or a longitudinal-spacing-bracing channel shown as a horizontal reverse lip channel 156 also shown in FIG. 18 & FIG. 40. FIG. 16 shows an oblong hole 36*o* where the horizontal U channel 155 just rests into the oblong hole 36*o*. FIG. 15 shows a rectilinear hole 36*rt*, however the side edges of the rectilinear hole 36*rt* have ledges 79. Some metal framing has holes 36 that have a ledge 79 around the edge shown as 79. The ledges 79 occur when the side edges of a hole 36 are large and the hole 36 side edges need additional strength, these ledges 79 can angle as much as a 45 degree angle causing the lip notches 126*p* explained in some later figures to be angled to accommodate the ledges 79. In FIG. 15 the ledges 79 make the rectilinear hole 36*rt* smaller and the horizontal U channel 155 is now supported by the ledges 79. The lip notches 126*p* in FIG. 81 would then be angled in order for the ledges 79 to be inserted into the lip notches 126*p*.

Figure 17:
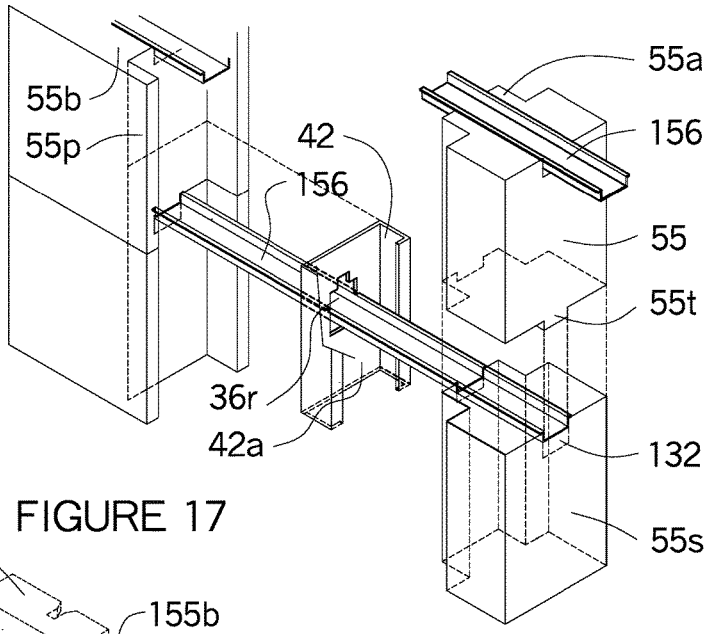
FIG. 17 shows and isometric view of the horizontal reverse lip channel with notches in the structural insulating wall.
Figure 18:
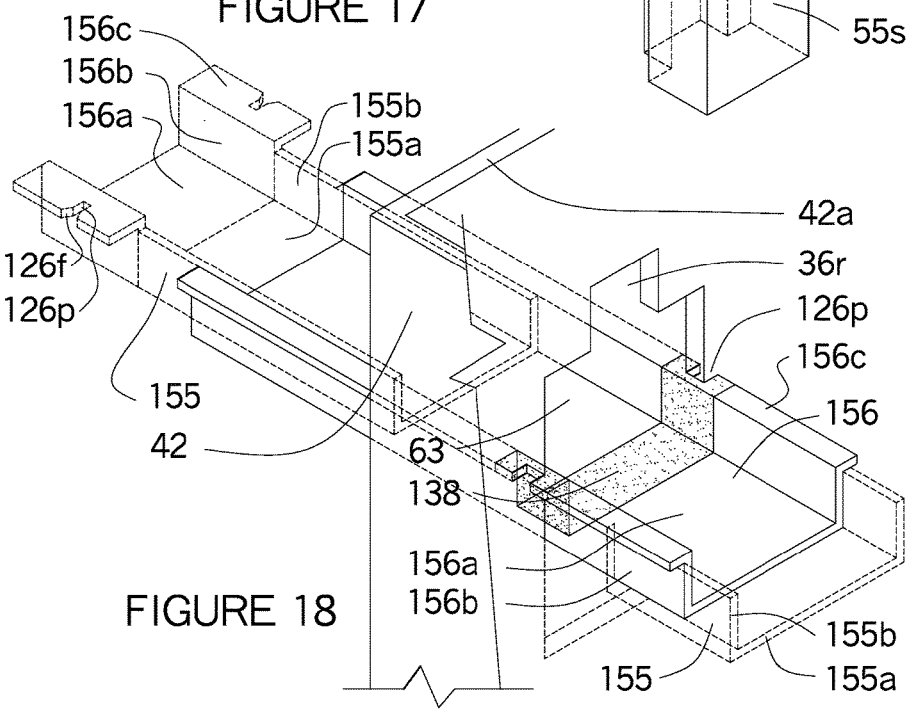
FIG. 18 shows an isometric view of a support channel with a rectilinear hole and the horizontal reverse lip channel with notches.
Figure 30:
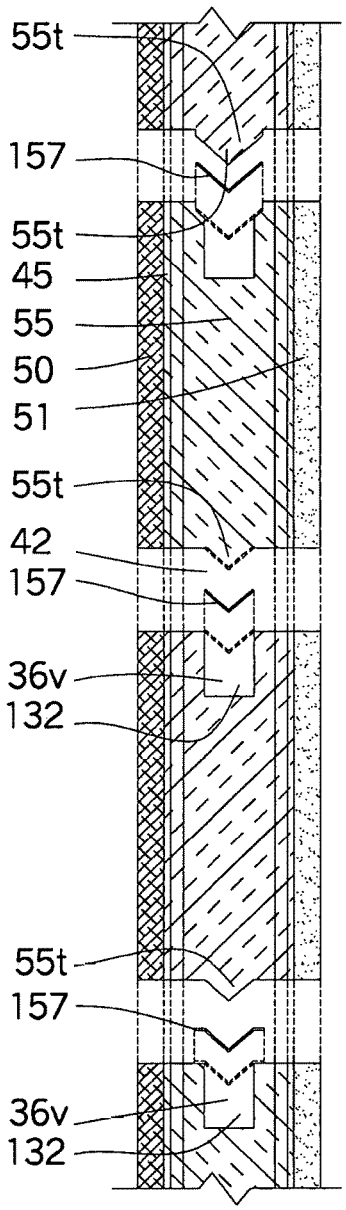
FIG. 30 show the same horizontal V channels however the V is pointing downward.
Figure 44:
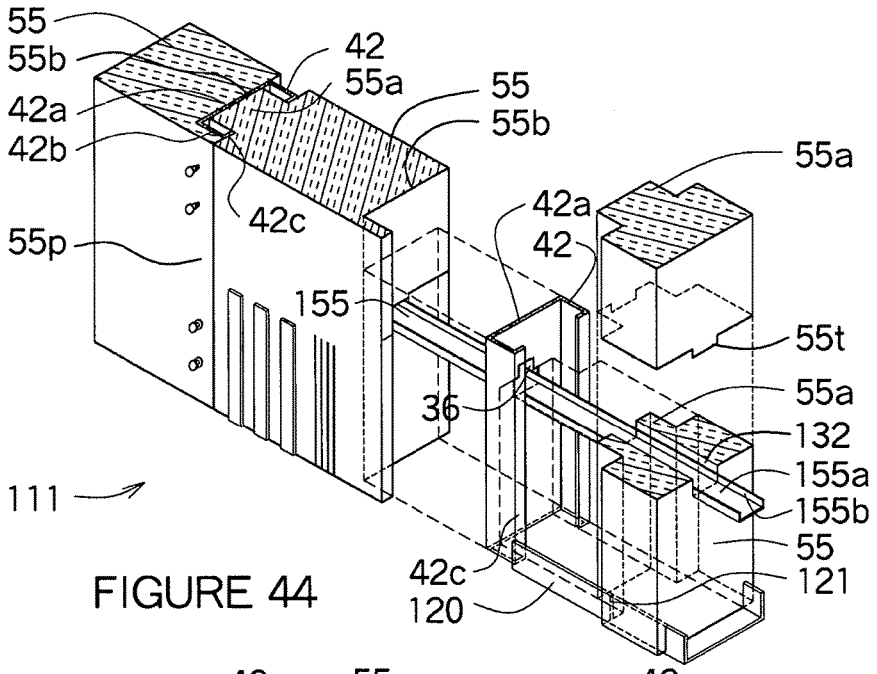
FIG. 44 is an isometric view where one side of the structural insulating core has projections overlapping the flange on one side and the opposite flange having no projections.
Figure 47:
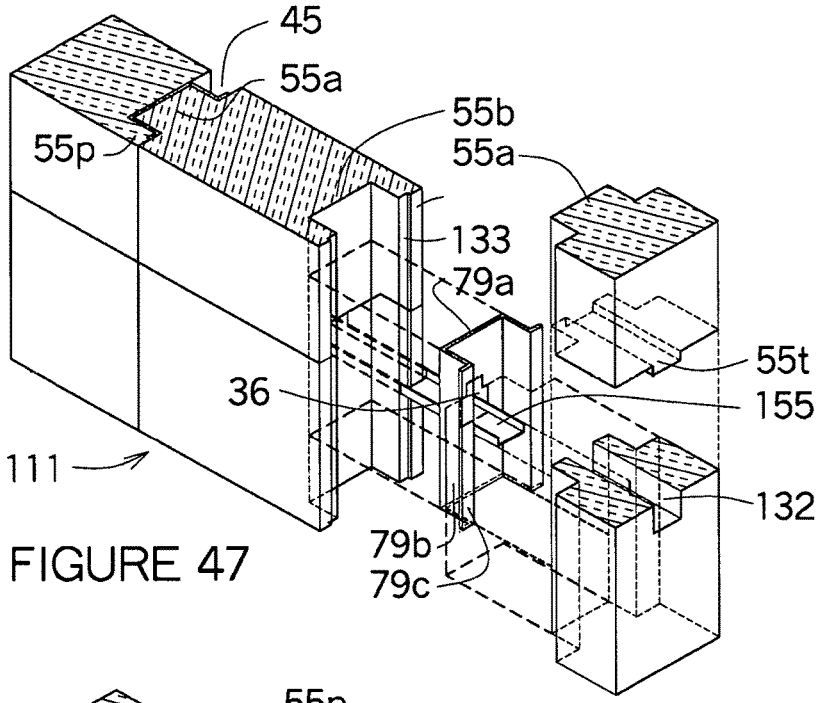
FIG. 47 is an isometric view of the of the reverse lip support channel as a support channel where the projection of the foam spacer overlaps one flange and not the other flange.
Figure 49:
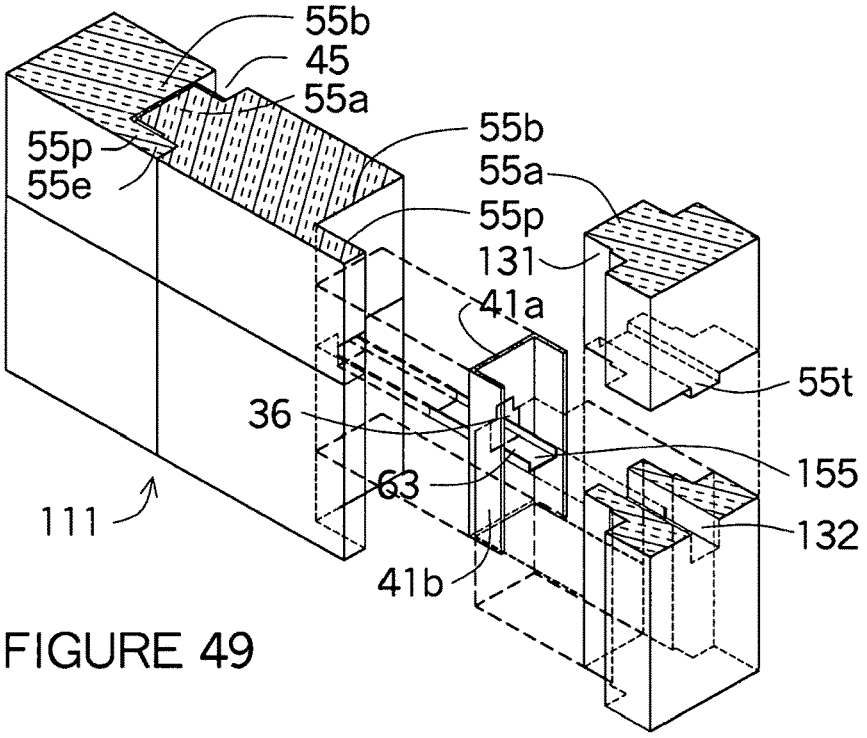
FIG. 49 is an isometric view of a U channel as a support channel and a horizontal U channel as a bracing channel and where the groove side of the foam spacer overlaps the flange and extends beyond the flange onto the adjacent foam spacer and the other side does not overlap the flange.

FIG. 17 is similar to FIG. 1 except the foam spacers 55 have projections 55*p* that overlaps the flanges 42*b* of the support channel shown as a C channel 42. Various other projections 55*p* are shown in FIGS. 44, 47 and 49. The longitudinal spacing-bracing member is shown as a horizontal reverse lip channel 156 with the exterior side of the lip 156*c* resting on the top of the short foam spacer 55*s* and the web 156*a* and flange 156*b* having the interior side fit into the horizontal tongue 55*t* and exterior side fit into the trough 132. An enlargement of the horizontal bracing channel 156 is shown in FIGS. 18 & 30 where the lip notches 126*p* fit into the web 42 through the rectilinear hole 36*rt* securing the foam spacer 55 with the C channel 42 to the horizontal reverse lip channel 156. An enlargement of the horizontal reverse lip channel 156 is shown in FIG. 18 with lip notches 126*p* that fit into the web 42 through the rectilinear hole 36*rt* securing the foam spacer 55 with the C channel 42 to the horizontal reverse lip channel 156. The horizontal reverse lip channel 156 does not have to span between multiple support channels, but can be shorter in length and installed as a multi-plane bracket 128 also shown in FIGS. 86 & 87 or as a coupling 63 also shown in FIGS. 84 & 85.

Figure 88:
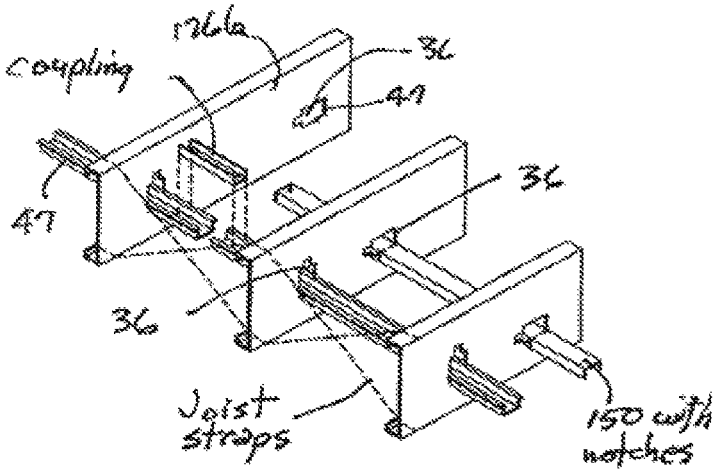
FIG. 88 is the same FIG. 112 shown in the Provisional Application U.S. 61/628,044 dated Oct. 24, 2011 as attached to this patent application.
Figure 89:
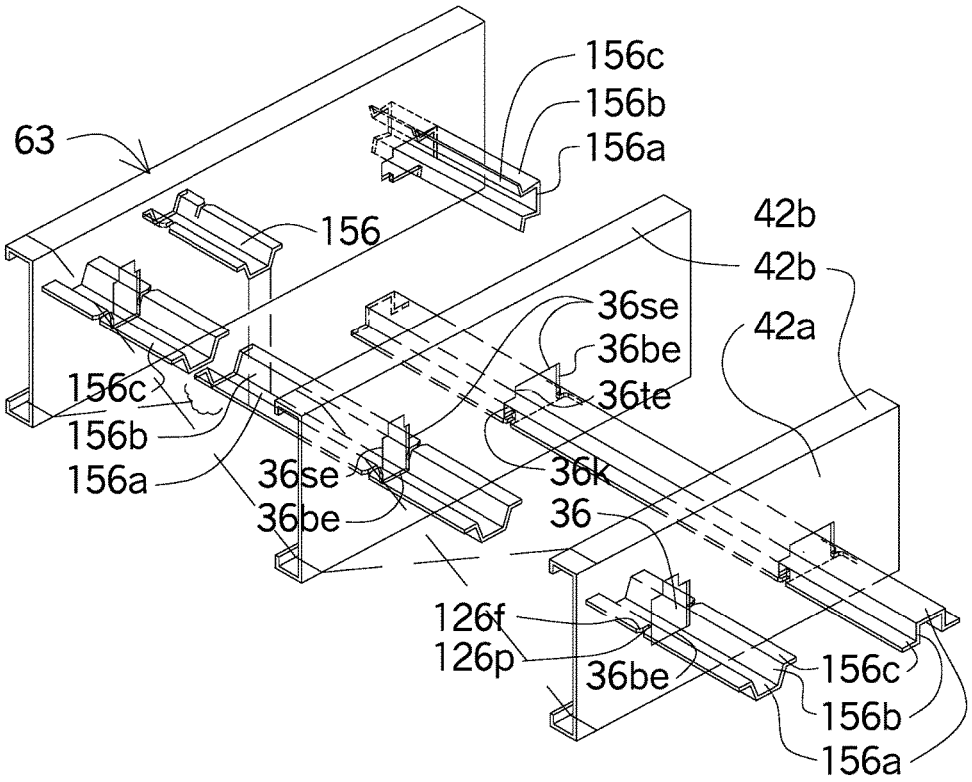
FIG. 89 is an enlargement of FIG. 88 and showing the reverse lip channel 156.

FIG. 18 shows how the reverse lip channel 156 can be connected to another horizontal bracing channel either using a horizontal U channel 155 or a horizontal reverse lip channel 156 similar to FIGS. 88 & 89. The lip notches 126*p* in the lips 156*c* are the key elements to secure the horizontal bracing members to the hole edges without using fasteners (not shown). It's like clothing you can mix and match. An installer can use a reverse lip channel 156 having vertical longitudinal flanges with another reverse lip channel 156 having angular longitudinal flanges 156*b* both have lip notches 126*p*, but the hole 36 is smaller than the width between lip notches, so the lip notches 126*p* have be cut to provide a deep lip notch 126*p* and continued in to the flanges 156*b* referred to as a flange notch 126*fg*. In another case the hole 36 in the support member is too large, then a coupling 603 or a bracket size with wider lips 156*c* with lip notches 126*p* to be installed into the hole side edges 36*se* at the support member. The stacked reverse lip channels 156 are then just fasten together with fasteners (not shown). Sometimes the reverse lip channels 156 are facing downward with the lips 156*c* against the hole bottom edge 36*be*, then the bracket or coupling would be fitting over the widest distance between flange 156*b* along with wider lips 156*c* and deeper lip notches 126*p*. There are probably 20-40 different variations of that connection when changing the hole configuration, the hole size and a number of other factors. Whether the horizontal bracing channel is a U channel 155 or a reverse lip channel 156 channels are installed into the hole 36 at an angle so the flanges 155*b* can fit tight against the hole side edges 36*se* or the lip notch 126*p* can be installed into the hole side edges 36*se* at the lip 156*c* on one side, then continually rotate the horizontal bracing channel to align with the lip notch 126*p* on the opposite side. In FIG. 18 the horizontal reverse lip channel 156 is shown as a coupling 63 that is secured to the web 42*a* of the support channel by lip notches 126*p* and connects to two other horizontal bracing channels 155 (shown dotted) on either side of the horizontal reverse lip channel 156. The horizontal U channel 155 on the left side rests on the web 156*a* and between the flanges 156*b* and is connected to the coupling 63. The opposed end of the coupling 63 shows another horizontal U channel 155 installed under the coupling 63 so the web 155*a* and flanges 155*b* are on the inside of the coupling 63 shown as a horizontal reverse lip channel 156. A coupling 63 connects two horizontal bracing channels, however this same horizontal reverse lip channel 156 can be a multi-plane bracket 128. A multi-plane bracket 128 functions differently than a coupling 63. A horizontal bracing channel shown as a horizontal U channel 155 passes through the hole 36 of the support channel on to another support channel and the multi-plane bracket 128 fits over the horizontal U channel 155 and the lip notches 126*p* of the multi-plane bracket 128 fit into the holes 36 of the support channel. The multi-plane bracket 128 is shown shaded to differentiate between the coupling 63 and the multi-plane bracket 128 which is shorter in length. The multi-plane bracket 128 fits into and between the flanges 155*b* and web 155*a* of the horizontal U channel 155. The coupling 63 and multi-plane bracket 128 can be used with the flanges 156 facing upward or downward. On the far left a U channel 155 is shown installed inside a reverse lip channel 156 between the flanges 156*b* and the lips 156*c*, with the lip notches 126*p* are installed at the hole side edges 36*se*, and secured by fasteners (not shown). Instead of installing the U channel 155 another reverse lip channel 156 can be install between the flanges 156*c* if the reverse lip channel is slightly smaller or the flanges 156*b* are angled and secured to the hole side edges 36*se* with lip notches 126*p*. The lip notches 126*p* secure the horizontal bracing channels to the support members and by changing sizes, shapes, orientation there are probably 50 different solutions which is impossible to display into this application, but still very easy for competitors to see all the alternative solutions.

Figure 19:
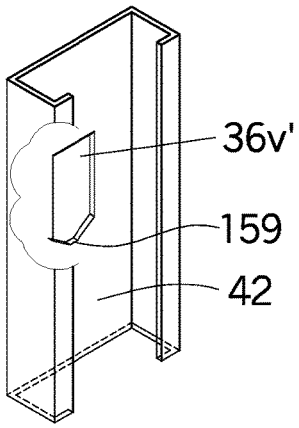
FIG. 19 is an isometric view of a C channel as the support channel with a V hole with the V pointing downward and a blunt end at the vertex of the V hole.
Figure 20:
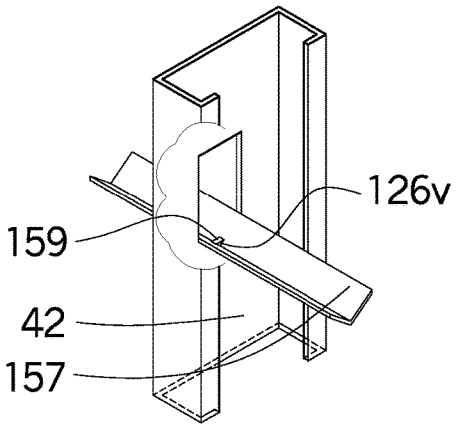
FIG. 20 shows the isometric view of FIG. 19 of the C channel with a horizontal V channel having a V-leg notches in the bottom received in the C channel.

Referring to FIGS. 19-20, the support channel, also known as a C channel 42, has a V-shaped hole 36*v*' with the bottom edge having V-shaped bottom walls ending in a blunt end 159 which is adapted to receive longitudinal spacing-bracing member shown as a horizontal V channel 157. The width of the horizontal V channel 157 is slightly less than the width of V-shaped hole 36*v*' and the horizontal V channel 157 slides right into the V-shaped hole 36*v*. The bottom of the horizontal V channel 157 has two or more spaced apart vertex notches 126*v* in the vertex of the member. The vertex notches 126*v* receive the blunt end 159 of the member to prevent horizontal movement of the horizontal V channel 157 within and between support channels. The vertex is the point of intersection of the two sides of the horizontal V channel 157.

Referring to FIGS. 21-24, the support channel also known as the C channel 42, has a V-shaped hole 36*v* with V-shaped bottom walls adapted to receive the longitudinal spacing-bracing member shown as a horizontal V channel 157. The width of the horizontal V channel 157 is slightly less than the width of V-shaped hole 36*v* and the width of the horizontal V channel 157 is larger than the width of V-shaped hole 36*v*. The horizontal V channel 157 has v-leg notches 126*vg* spaced along the diagonal side walls of the horizontal V channel 157 that extends inward from the edges. The distance between the closest ends of each pair of v-leg notches 126*vg* being less than the width of the V-shaped hole 36*v*. The horizontal V channel 157 is received within V-shaped hole 36*v* by rotating the horizontal V channel 157 longitudinally. —The height of the diagonal side walls are usually the same but can vary if the angle of the V-shaped is different. When the v-leg notches 126*vg* are aligned with the wall of the web of C channel 42, the horizontal V channel 157 is turned 90 degrees with the vertex of the member pointing downward. The side edge of the hole at the web 42 of the C channel 42 receives the v-leg notches 126*vg*; this secures the horizontal V channel 157 with the C channel 42.

Still referring to FIG. 21-24, the support channel shown as C channel 42 having an indentation 42*i*, but has an indentation at the web 42*a* for strengthening. This feature is optional in the present invention. The V-shaped hole 36*v* in indentation 42*i* is identical to the V-shaped hole 36*v* in support channel 42 (See FIGS. 21-23). The support channel being a C channel 42 receives horizontal U channel 155. The horizontal U channel 155 has corner notches 126*c* located on the corners where the flanges 155*a* and web 155*b* intersect. The corner notches 126*c* in each corner are opposite one another. The corner notches 126*c* engage the wall of the web 42*a* at the point where the bottom edge of the hole wall angles inward to form the V. This engagement prevents the support channel from moving horizontally.

Figure 21:
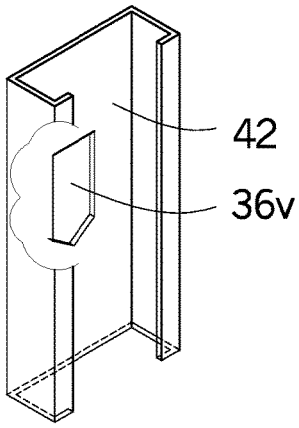
FIG. 21 is an isometric view of a C channel as the support channel with a V hole and the V pointing downward.
Figure 22:
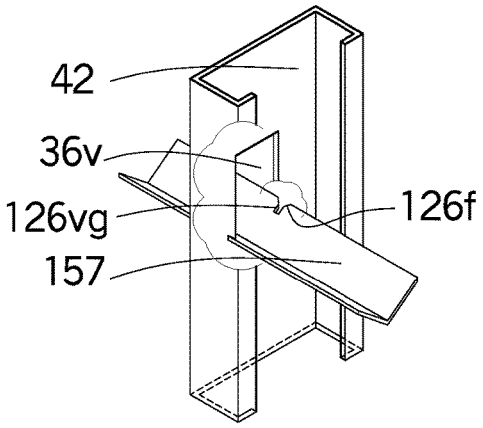
FIG. 22 shows the support channel of FIG. 21 with a horizontal V channel with leg notches at the edges engaging the hole in the support channel.
Figure 23:
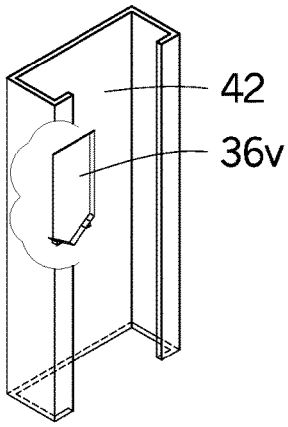
FIG. 23 is an isometric view of a C channel as the support channel with a V hole and the V pointing downward.
Figure 24:
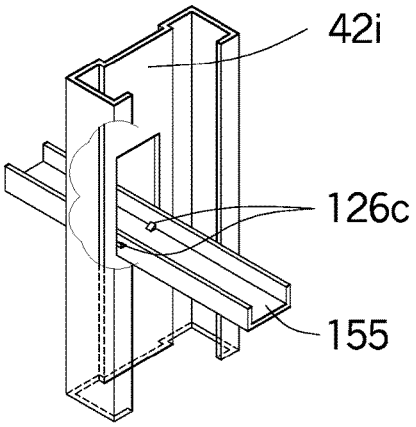
FIG. 24 shows the support channel of FIG. 23 with a longitudinal spacing-bracing member with corner notches in the web received in the blunt end.

Many of the previous figures show several support channels and the longitudinal spacing-bracing member having various notches engaging the V-shaped hole 36*v* in the adjacent support channels. FIGS. 21 & 23 both show the pointed configuration in the V-shaped hole 36*v* at the bottom of the V-shaped hole 36*v*. The horizontal V channel 157 rests in the pointed configuration of the V-shaped hole 36*v* and the V-leg notches 126*vg* & corner notches 126*c* engage into the V-shaped hole 36*v*. FIG. 22 also have the exterior dorsal side of an elongated V-shape body in cross section having first and second longitudinal walls joined at the vertex of the V-shaped body. The exterior side fits into the V-shaped hole 36*v* having the same oriented configuration however the V-leg notches 126*vg* occur at the side edges of the longitudinal sides of the V-shaped body. The V-leg notches 126*vg* have a flare 126*f* at the side edges which is wider than the V-leg notches 126*vg* in order for the side edges of the V-shaped hole 36*v* to slide into the V-leg notches 126*vg* easier. The wider the opening of the flare 126*f* the easier the V-leg notches 126*vg* have in engaging the side edges of the V-shaped hole 36*v*. FIG. 24 shows the longitudinal spacing-bracing member as a horizontal U channel 155 having an elongated web 155*a* with first and second longitudinal wall edges being connected and extending upward away from the web 155*a* forming first and second longitudinal walls are shown as flanges 155*b* forming a U-shape. When the horizontal U channel 155 is inserted into a V-shaped hole 36*v*, corner notches 126*c* in the web 155*a* and the flanges 155*b* form continuous corner notches 126*c* between the longitudinal web 155*a* and the longitudinal walls of the flanges 155*b* at the corner notches 126*c*. The bottom side edges that extend from the V-shaped holes 36*v* penetrate the corner notches 126*c* from the exterior side and extend into the interior side of the horizontal U channel 155. A reverse lip channel 156 with lip notches 126*p* can be used instead of the horizontal U channel 155 for additional horizontal support at the support channels. FIG. 23 indicates where the corner notches 126*c* from the horizontal U channel 155 would set on the bottom edges of the V-shaped hole 36*v*.

Figure 25:
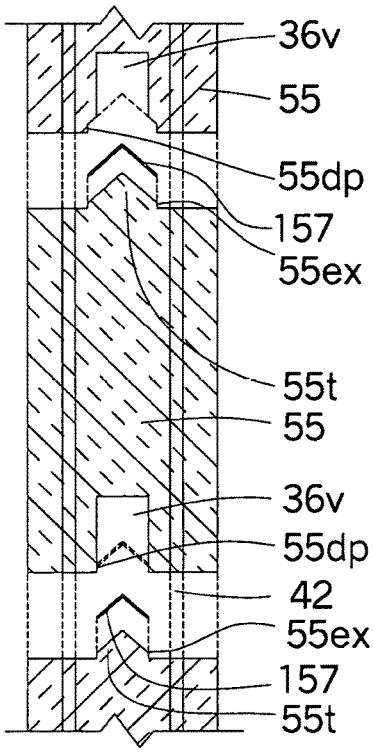
FIG. 25 shows a wall section of the horizontal V channel pointing upwards and the trough is above the horizontal V channel.
Figure 26:
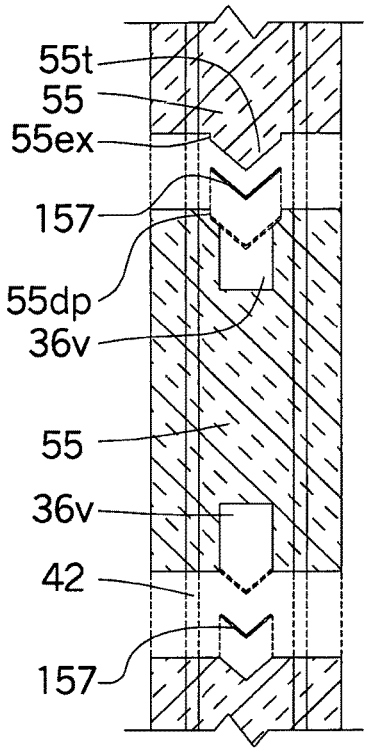
FIG. 26 shows a wall section where the horizontal V channel is pointing downward and the trough is below and the horizontal tongue of the foam spacers requiring an extension.
Figure 27:
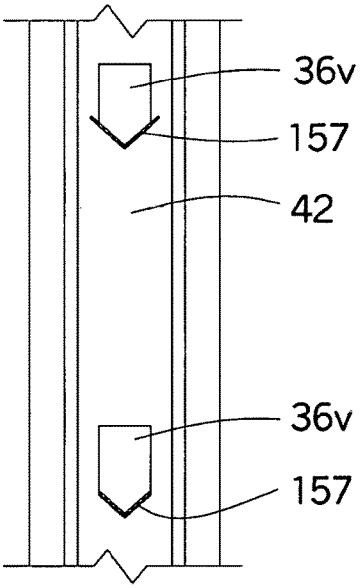
FIG. 27 shows a wall section where the horizontal V channel is pointing downward.
Figure 28:
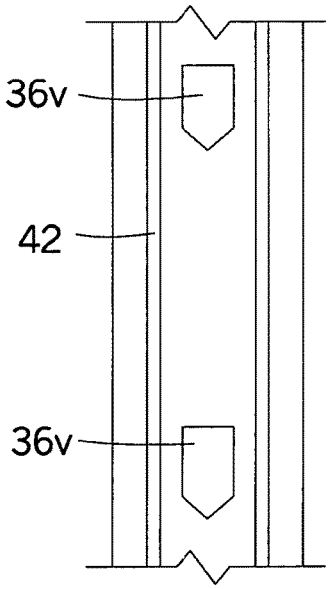
FIG. 28 shows the wall section with on V hole and the V is pointing downward.
Figure 29:
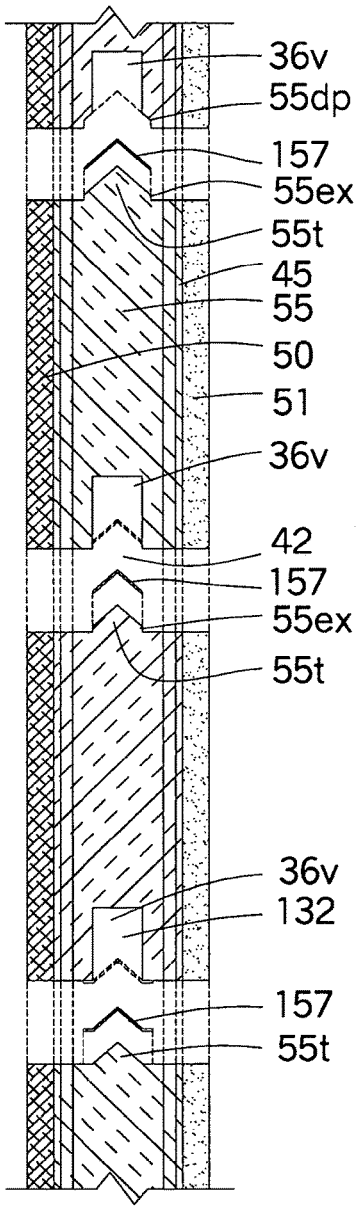
FIG. 29 is a wall section showing the horizontal V channel is wider and has a notch requiring an extension of the horizontal tongue, while another section shows the horizontal V channel within the size of the V hole and lastly where the horizontal V channel is bent with notches.

FIGS. 25-30 show different variations locations of the V-shaped hole 36*v* and the foam spacers 55. FIGS. 25 & 29 shows the horizontal V channel 157 shown with the interior side configuration pointing upwards. When the pointed configuration is pointed upward, the trough 132 is above the horizontal V channel 157 and the horizontal tongue 55*t* is also pointed and fits into the horizontal V channel 157. The horizontal tongue 55*t* has a foam extension 55*ex* to the horizontal tongue 55*t* to form a better interlocking fit between two foam spacers 55. The trough 132 is shown rectilinear with a trough depression 55*dp* to accommodate the horizontal tongue 55*t* has an foam extension 55*ex*, however a pointed configuration could also be used in the V-shaped hole 36*v* and within the foam spacer 55. The upper horizontal tongue 55*t* is wider to accommodate the V-leg notches 126*vg* in the horizontal V channel 157, however the trough 132 is narrower to fit the size of the V-shaped hole 36*v*. FIG. 28 shows the V-shaped hole 36*v* with the pointed configuration pointing downward and FIG. 27 shows the horizontal V channel 157 in two sizes, that is the larger horizontal V channel 157 having corner notches 126*c* and a bent flange in FIGS. 29 & 30. Elderson at ClarkDietrich has many patent variations of the V channels 157 with notches 126 and overlapping channels that are shown in this applications, where the horizontal V channels 157 has the V-shape pointing upward, while the LeBlang application shows the hole bottom edge 36*be* having different shapes as well as the vertex of the V channels 157. FIG. 26 shows both sizes of the horizontal V channels 157 being installed in the foam spacers 55. When the horizontal V channels 157 have the pointed configuration pointing downward, the trough 132 is better when installed below the horizontal bracing channel 157 so the horizontal tongue 55*t* can fit into the horizontal V channel 157. The horizontal V channel 157 in the lower wall section shows a bent flange with a V-leg notches 126*vg* on the horizontal V channel 157. When using that configuration the horizontal tongue 55*t* fits into the V configuration of the horizontal V channel 157, however a foam extension 55*ex* is not used making the connection between spacer blocks less secure.

Figure 34:
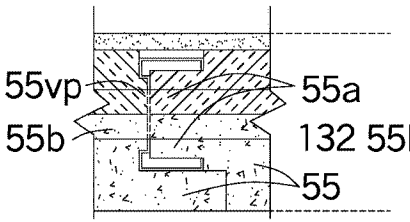
FIG. 34 shows a plan view the foam spacer is formed from different material and the support channel has an indentation in the web.
Figure 35:
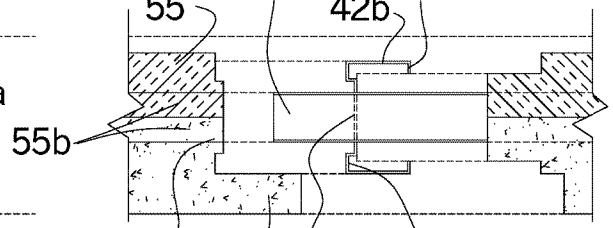
FIG. 35 shows the plan view separated by the C channel and the two foam spacers.
Figure 33:
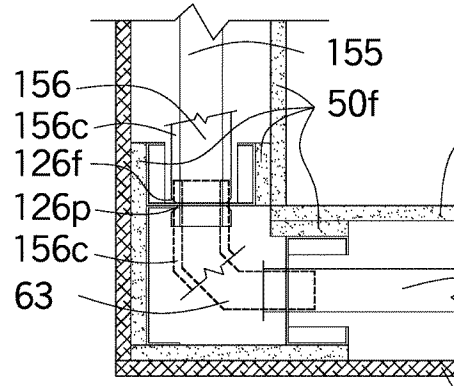
FIG. 33 shows a corner connection of two wall panels and the coupling between them connects the two wall panels together.
Figure 34:
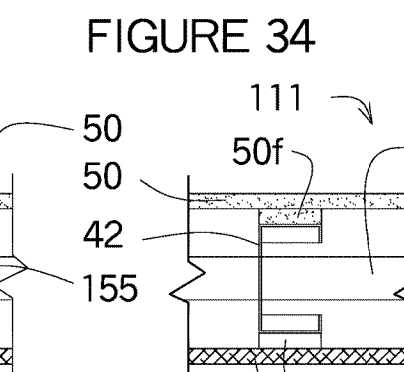
Figure 32:
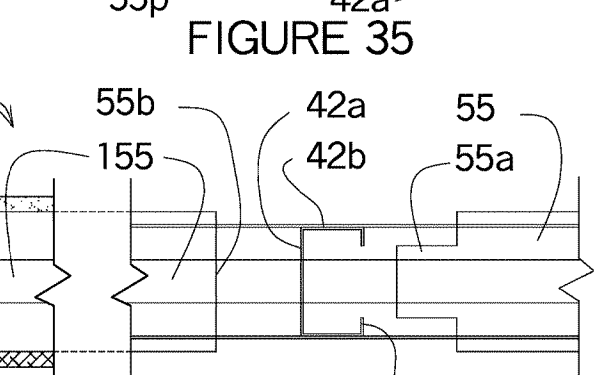
FIG. 32 shows a plan view of the wall section in FIG. 31.
Figure 36:
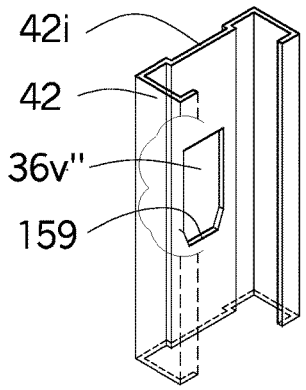
FIG. 36 shows an isometric view of a C channel with an indentation in the web having a partially tapered hole pointing downward to a blunt end at the vertex.
Figure 37:
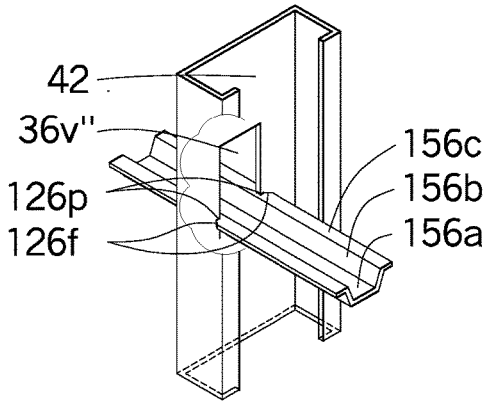
FIG. 37 show the C channel of FIG. 36 with a horizontal notched reverse lip channel received in the C channel with the lip notches engaging the C channel.
Figure 38:
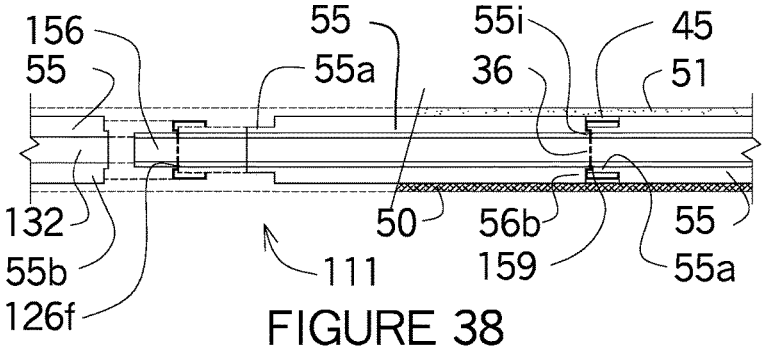
FIG. 38 shows a plan view of FIG. 37 showing the lip notches and flares at the lips engaging the V hole.
Figure 39:
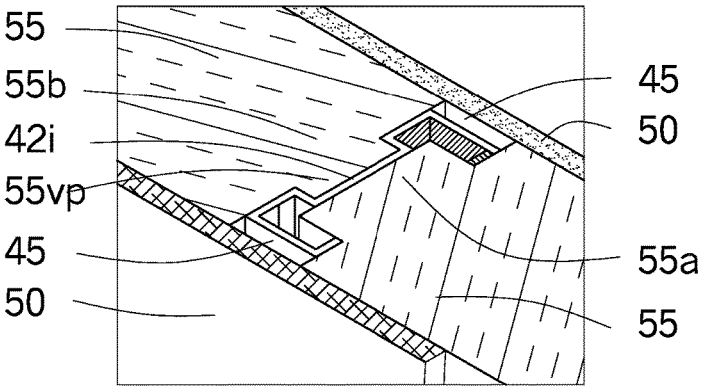
FIG. 39 shows an enlargement of the support channel with an indentation and the vertical projection of the spacer block fitting into the indentation and the gap between the inner and outer walls.

FIGS. 31-39 shows the support channel with an indentation 42*i* in the C channel 42 allowing for a better connection at the tongue shape 55*a* and groove shape 55*b* in the foam spacers 55. FIG. 31 shows a wall section using the a horizontal U channel 155 with the web 155*a* and flanges 155*b* having its interior sides facing downward over the horizontal tongue 55*t* in the lower foam spacer 55 with the trough 132 in the upper foam spacer 55. The rigid board 50 and rigid insulation 51 are shown on both sides of the foam spacer 55 as shown in FIG. 1. The base plate 120 is shown attached to the flanges 42*b* of the C channel 42 leaving a gap 45 between the inner and outer boards. FIGS. 32 & 33 shows a plan view of the wall panel and the gap 45 that is formed when the foam spacer 55 extends past the C channel 42 and the rigid board 50 and rigid insulation 51 are attached to the foam spacer 55. FIG. 33 shows a rigid board filler 50*f* attached to the flanges 42*b* of the C channel 42 in the area occupied by the gap 45 at the corner of where two wall panels intersect in order to make a more solid connection. A coupling 63 or the connection between stacked horizontal reverse lip channel 156 or horizontal U channels 155 can be smaller or larger in size as shown on the right side or as a horizontal reverse lip channel 156 either used as a connection between straight member or at corners, that are angled or L-shaped and fits between the flanges when fitting over or under a horizontal spacing-bracing channel. The connection between two different widths of reverse lip channels 156, the reverse lip channels 156 can have the longitudinal ends of a connecting reverse lip channel 156 have two different sizes or shapes of longitudinal ends to fit into the different sized reverse lip channels 156. The coupling 63 can be square shaped a rectilinear appearance, angular (as shown) or curved in order to make a direct connection between the two wall panels. In addition, when the horizontal reverse lip channel 156 are connecting two adjacent support members, the lip notches 126*p* will have to be cut or trimmed wider to accommodate both support members. There are many ways to manufacture a curved U-shaped channel 155 or reverse lip channel 156 including the curved web, side walls and lip configurations. FIG. 35 shows two different half sections of the foam spacer 55 with each half section shown as two different materials. In addition, one side of the foam spacer 55 has the foam spacer 55 extending past the flange 42*b* causing a gap 45 as shown in FIG. 11 and the opposite side of the foam spacer 55 shown with an a projection 55*p* and the foam extension 55*ex* at the groove shape 55*b* as well as a vertical projection 55*p*. The vertical projection 55*vp* projects from the foam spacer 55 into the indentation 42*i* of the C channel 42. FIG. 36 shows an indentation 42*i* in the web 42*a* of the C channel 42 with a V-shaped hole 36*v*". The V-shaped hole 36*v*" has a larger blunt end 159, however the blunt end 159 is different than in FIG. 19 as the blunt end 159 and the angular side edges of the V-shaped holes 36*v*" are used to support the longitudinal spacing-bracing member shown as a horizontal reverse lip channel 156 having an elongated web 156*a* with first and second angular edges being connected and extending away from the web 156*a* forming first and second longitudinal walls are shown as flanges 156*b* in FIG. 37. The flanges 156*b* can also be bent inward with longitudinal lips extending away from longitudinal walls, is shown in other patent pending applications but not shown in this application. The free side edges of the lips 156*c* have notches 126 cut inward from the free side edges. At the free side edges of the lips 156*c* a flare 126*f* is shown at the lip notch 126*p* to form a wider opening into the lip notch 126*p*. The horizontal reverse lip channel 156 is shown passing through a V-shape hole 36" having the bottom edge or blunt end 159 parallel to the web 156*a* of the longitudinal spacing-bracing member where the side edges of the two lip notches 126*p* are resting on both side edges of the hole 36 at the web 42*a*. FIG. 24 shows the web 156*a* horizontal to the lips 156*c* with the flanges 156*b* having angular side edges similar to the V-shaped hole 36*v* within the support channels. As shown in the previous figures the longitudinal spacing-bracing members connect support channels together whether installed as a continuous longitudinal spacing-bracing member or stacked upon each other when connecting to the same support member. The longitudinal spacing-bracing member with angular flanges can be stacked between the vertical flanges 156*b* of a rectilinear longitudinal spacing-bracing member having more vertical flanges 156*b* and having a checker board pattern of installation always installing the angular flange 156*b* between the more vertical flanges 156*b*. FIGS. 38 & 39 show the wall panel and an enlargement of the gap 45 with the indentation 42*i* in the C channel 42 along with the rigid board 50 and rigid insulation 51. The plan view in FIG. 38 also showing the lip 156 having the flares 126*f* on both sides of the lip notches 126*p* when intersecting the at the hole 36.

Figure 40:
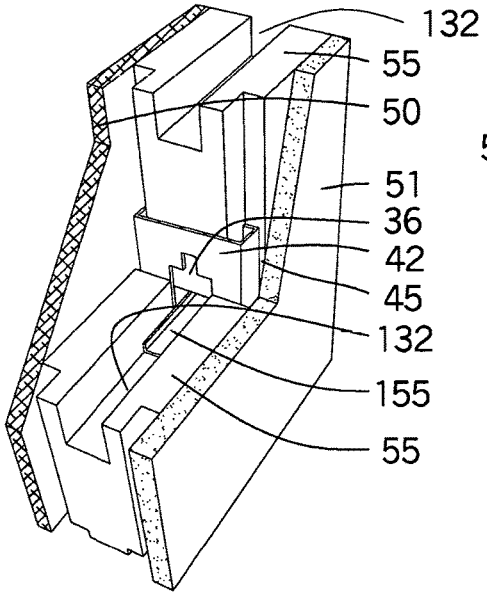
FIG. 40 shows a perspective view of the spacer block intersecting the C channel and horizontal bracing channel forming a gap.
Figure 41:
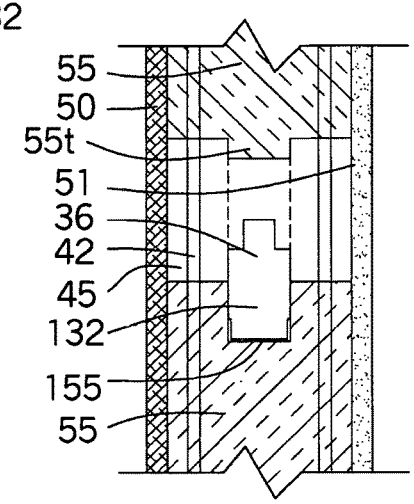
FIG. 41 shows a wall section of FIG. 40 where the horizontal tongue fits into the trough.
Figure 42:
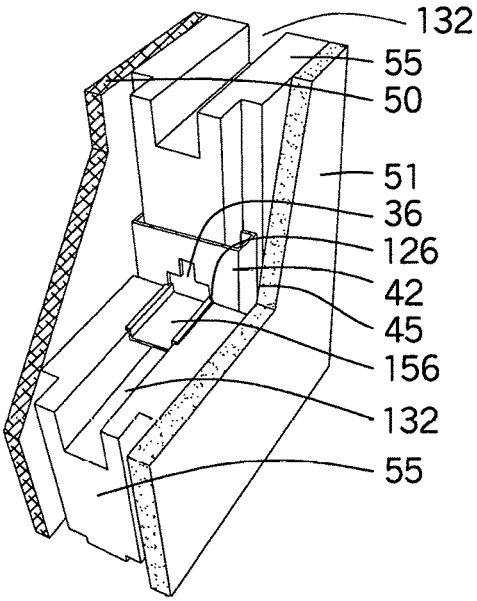
FIG. 42 shows a perspective view of the spacer block intersecting the C channel and the horizontal reverse lip channel.
Figure 43:
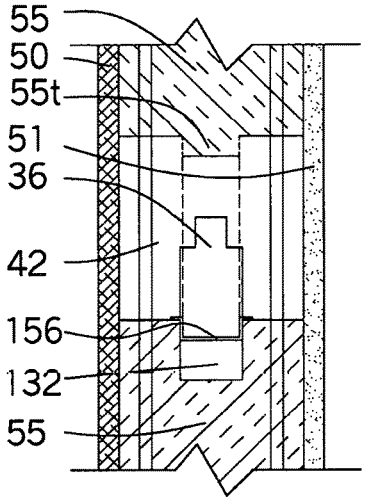
FIG. 43 shows a wall section of FIG. 42 where the horizontal tongue fits between the flanges of the horizontal reverse lip channel and the trough is below the horizontal bracing channel.

FIGS. 40 & 41 show and enlarged view of the horizontal bracing channel shown as a horizontal U channel 155 fitting into the bottom of the trough 132 and the hole 36 in the support channel shown as a C channel 42. The foam spacers 55 are shown with the gap 45 between the C channels 42 and the rigid board 50 and the rigid insulation 51. The horizontal tongue 55*t* fits into the trough 132 in FIG. 41 but when the longitudinal spacing-bracing member shown as a horizontal reverse lip channel 156 in FIG. 43 the horizontal tongue 55*t* fits into the interior side of the horizontal reverse lip channel 156. When using the horizontal reverse lip channel 156 the trough 132 is best located below the horizontal reverse lip channel 156 in order to have the horizontal tongue 55*t* fit between the flanges 156*b* for a snug fit.

Figure 45:
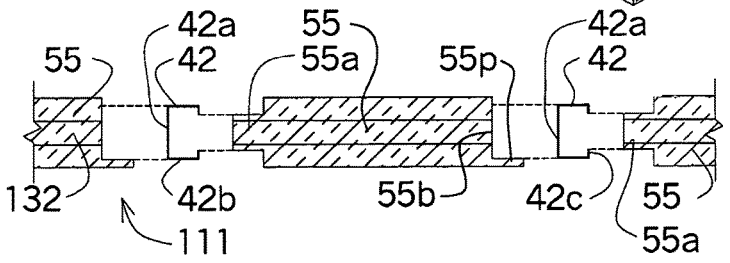
FIG. 45 is a plan view of FIG. 44.
Figure 46:
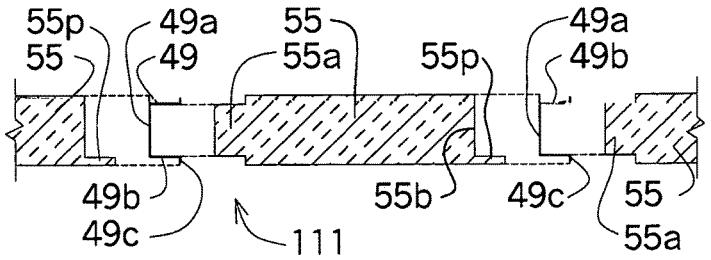
FIG. 46 is a plan view of FIG. 47.
Figure 48:
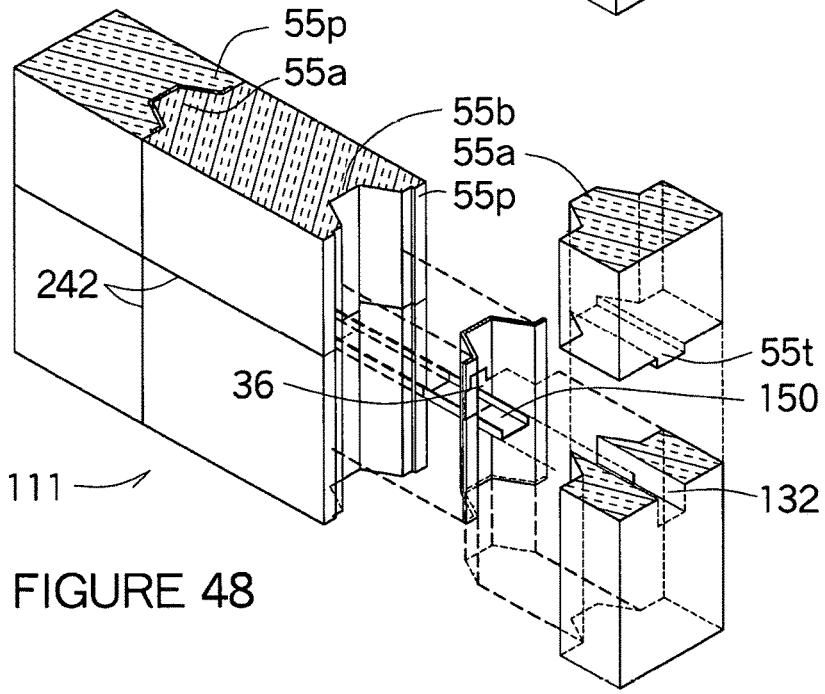
FIG. 48 is an isometric view of a hat support channel as the support channel or bracket with both sides of the foam spacer overlaps the sloped flange and a short horizontal U channel connecting the foam spacers.
Figure 50:
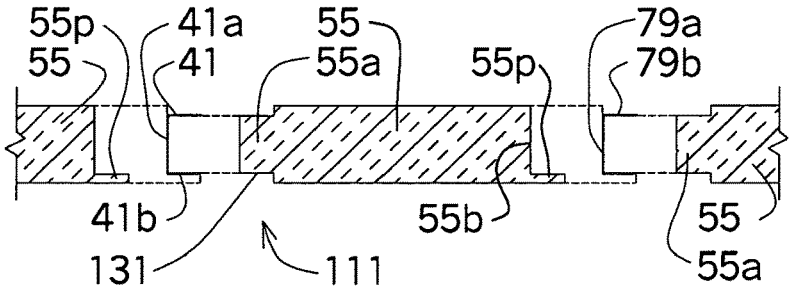
FIG. 50 is a plan view of FIG. 49.
Figure 51:
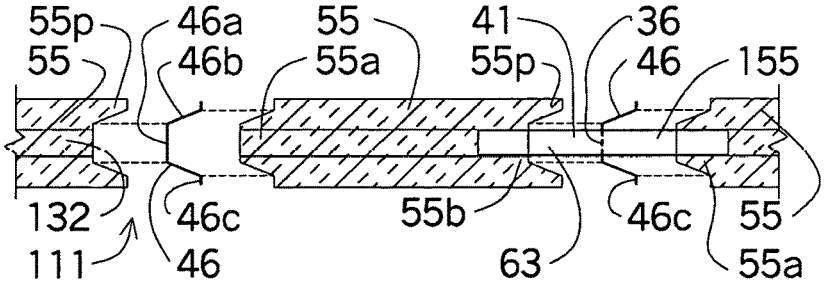
FIG. 51 is a plan view of FIG. 48
Figure 52:
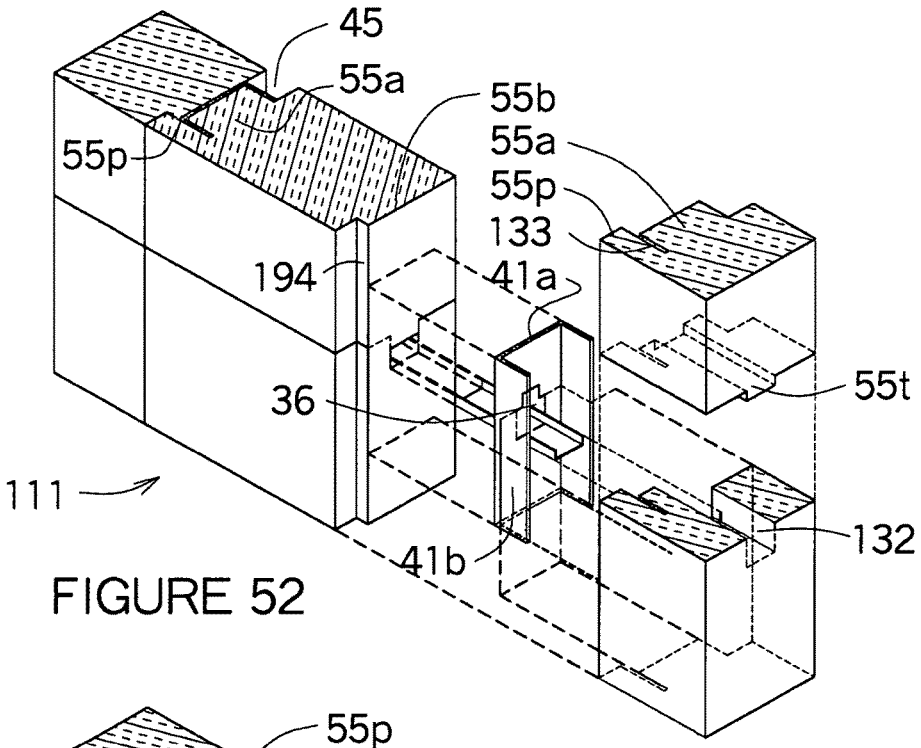
FIG. 52 is an isometric view similar to FIG. 49, except here the tongue shape of the foam spacer also has the projection of the foam spacer with the extension that rests on the adjacent foam spacer and the opposite of the foam spacer has no overlap.
Figure 53:
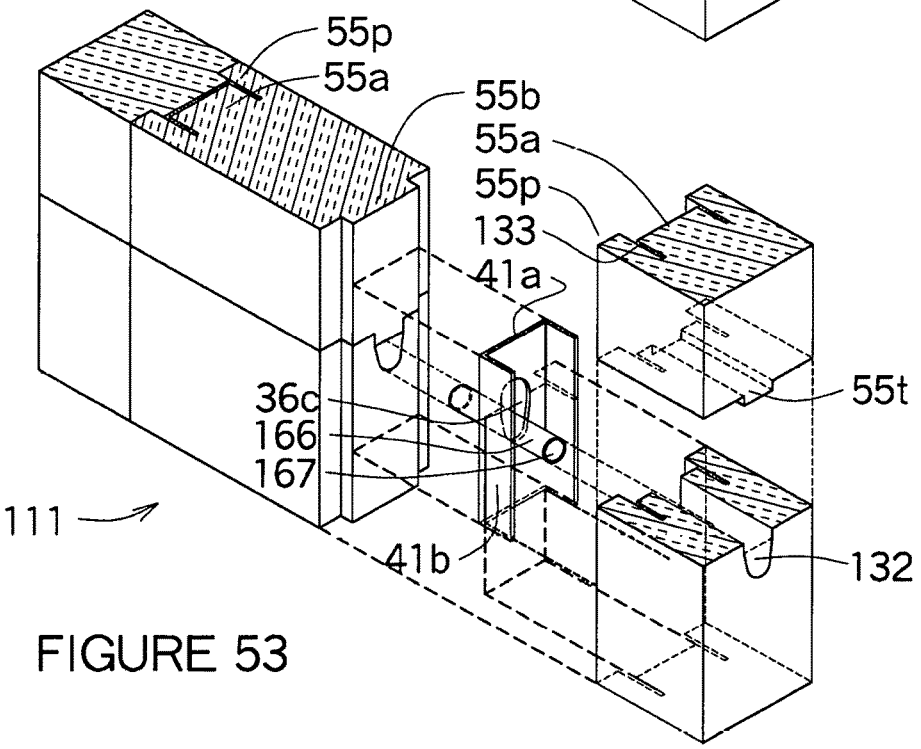
FIG. 53 is an isometric view similar to FIG. 52 except both sides of the foam spacers have projections and extensions over the U channel and the round hole is used for a round rod to connect two foam spacers together.

FIGS. 44-53 shows various structural insulating cores 111 with projections extending over one flange of the support channels similar to the projections shown in FIGS. 34 & 35. In FIGS. 44 & 45 the projection 55*p* extends over the flange 42*b* of the C channel 42, but stops at the end of the flange 42*b* by the lip 42*c*. The base plate 120 has a groove 121 in the foam spacer 55 for the flange 120*b* of the base plate 120 fits over the flange 42*b* of the C channel 42. FIG. 45 shows a plan view of FIG. 44, showing the trough 132 at the top of the foam spacer 55. FIGS. 46 & 47 show a plan view and isometric view of the support channel as a reverse lip support channel 49 where the projection 55*p* stops at the lip 49*c* and the opposite side has no projection. FIGS. 48 & 51 show an isometric view and a plan view of the hat support channel 70 as support channels. The hat support channel 70 and the reverse lip support channel 49 have a lip 70*c* & 49*c* where the projections 55*p* overlap the support channels. The hat support channel 70 works well if the spacer block is load bearing like a concrete block since the sloped slides do not allow drywall or other rigid boards 50 and rigid insulations 51 (not shown) to be fastened to the hat channel 70. Since the support channel and horizontal bracing channel interlock with each other, the foam spacers 55 can be installed with or without mortar 242 between the foam spacers 55. FIG. 51 shows a horizontal bracing channel overlapping both foam spacers 55 and secures the support channel shown as a hat channel 70 interlocking all three together. FIGS. 49 & 50 shows the projection 55*p* extending over the flange 41*b* and to the indentation 41*i* of the adjacent spacer block. The projection 55*p* is shown on the groove shape 55*b* of the foam spacer 55 like as shown in FIGS. 34 & 35. FIG. 52 shows the groove shape 55*b* and the projection 55*p* on the same side of the foam spacer 55 and FIG. 53 shows the projection 55*p* on the opposite side of the foam spacer 55. FIG. 53 shows round hole 36*c* with the horizontal bracing channel shown as round rod 166 along with the trough 132 conforming to the round rod 166 where the rides shown in FIG. 12 interlock the support channel, round rod 166 or hole tube 167 and foam spacer 55 interlock together.

Figure 54:
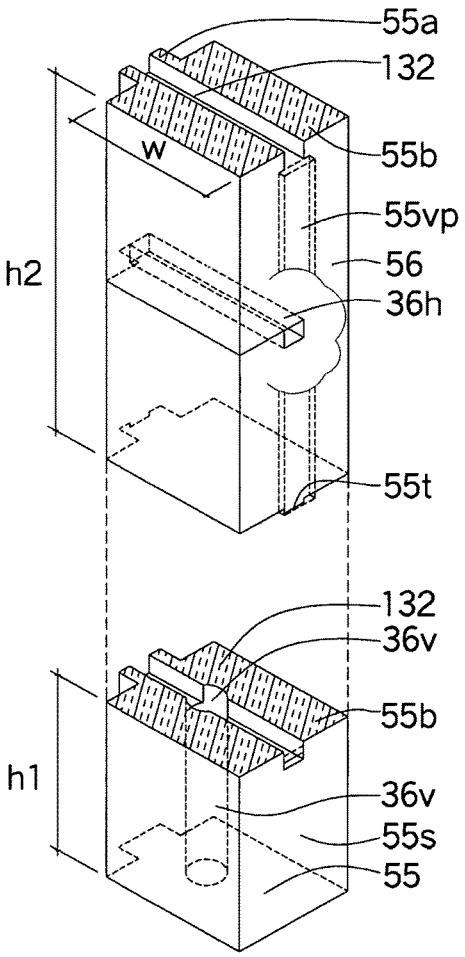
FIG. 54 shows an isometric of two foam spacers stacked above each other shows the vertical project, troughs and the vertical hole in the short foam spacer.
Figure 55:
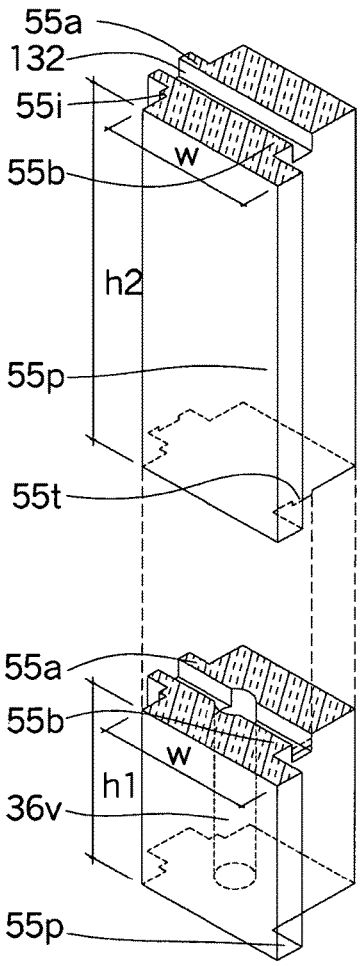
FIG. 55 is similar to FIG. 54 except one side of the foam spacer has a projection and the other side does not.

FIGS. 54 & 55 shows enlarged views of the foam spacer 55 and the short foam spacer 55*s*. FIG. 54 shows the foam spacer 55 with no projections so the foam spacer 55 extends past the support channels so a gap 45 (not shown) is between the support channels. The vertical projection 55*vp* of the foam spacer 55 extends into the indentation 42*i* of the C channel 42. FIG. 55 shows the projection 55*p* on one side of the foam spacer 55 and a foam indentation 55*i* on the opposite side allowing the projection 55*p* to fit into an adjacent foam spacer 55. Both FIG's the width W is the distance between adjacent foam spacers 55 blocks 56 and the height h1 and h2 show the height of each foam spacer 55 & 55*s*. Both FIGS. 54 & 55 show a V-shaped hole 36*v* in the short foam spacers 55*s*.

Figure 56:
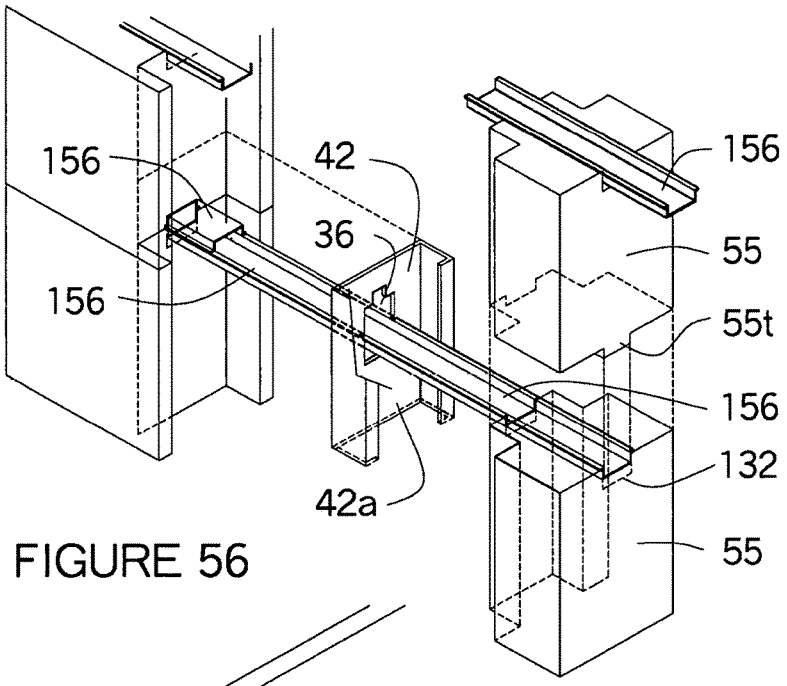
FIG. 56 shows an isometric of the structural insulated core where an electric chase with a cover on top of the lower horizontal reverse lip channel.
Figure 57:
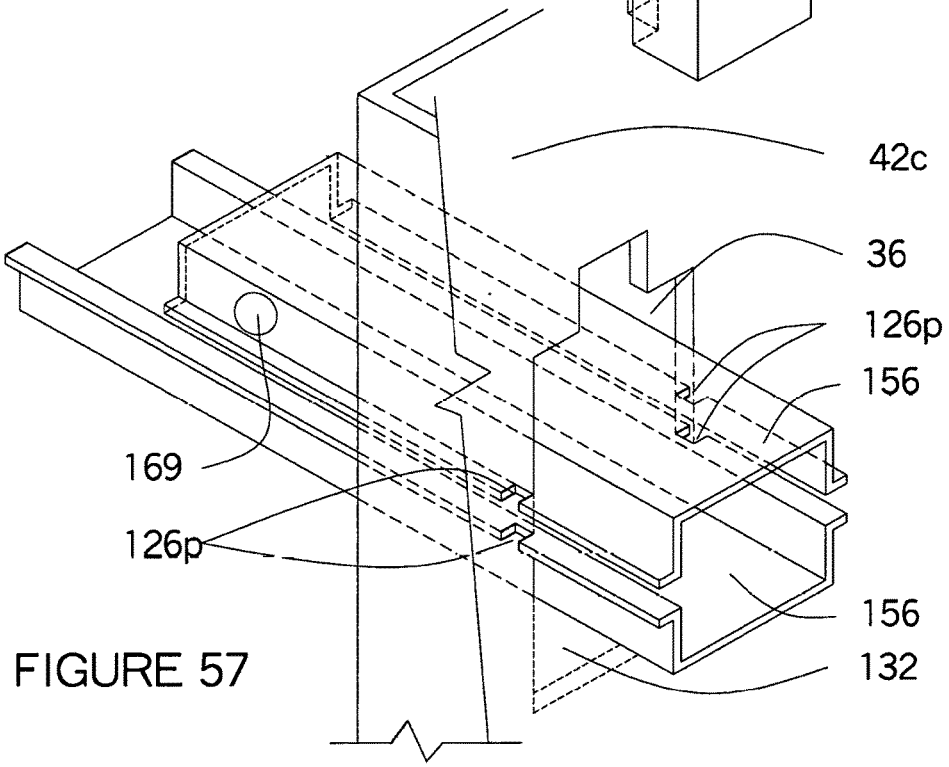
FIG. 57 shows an enlargement of a reverse lip channel with lip notches stacked inverted to another reverse lip channel with lip notches engaging the support member for the electric chase passing through the rectangular hole.

FIG. 56 shows foam spacer 55 connected by a longitudinal spacing-bracing member and the support channel shown as a C channel 42 with a hole 36. The longitudinal spacing-bracing member is shown as a horizontal reverse lip channel 156 where the exterior side of the web 156*a* fits into the trough 132 with the flanges 156*b* abutting the sides of the trough 132 and the lips 156*a* resting on top of the foam spacer 55 so the horizontal reverse lip channel 156 is facing upwards so the flanges 156*b* and the web 156*a* form are exposed forming a U shape with the lip notches extending on both side planes at the hole 36 in web 42. In FIG. 57 another horizontal reverse lip channel 156 is installed upside down over the first horizontal reverse lip channel so the lips 156*c* abut each other and their respective lip notches 126*p* are touching each other forming a cover over the first horizontal reverse lip channel 156. The top horizontal reverse lip channel 156 shows a punched hole 169 so electric conduits (not shown) can be attached. In addition, the upward facing reverse lip channel 156 can be installed between several support member and the next reverse lip channel 156 is installed downward between several support members. As shown in FIG. 37 a reverse lip channel 156 with its angular longitudinal sides or flanges 156*b* can also be installed within the upward facing reverse lip channel 156 also shown in FIG. 89. In FIG. 33 shows a plan view with over two horizontal bracing-spacing member crossing at the hole 36 in the support member. Many different variations of the horizontal spacing-bracing member can be combined to make: a V-shape horizontal spacing-bracing member with lip notches, a U shape angled with lip notches, a U shape with lip notches, and a horizontal spacing bracing member with angled flanges fitting into a V shape with lip notches. The hole openings are manufactured in three different sizes causing the flanges to have flange notches 126*f* along with lip notches 126*p*, plus the web 156*a*. Longitudinal walls and lips can have multiple sides when creating grooves or ribs plus the reverse lip channel can be installed right side up or upside down.

Figure 58:
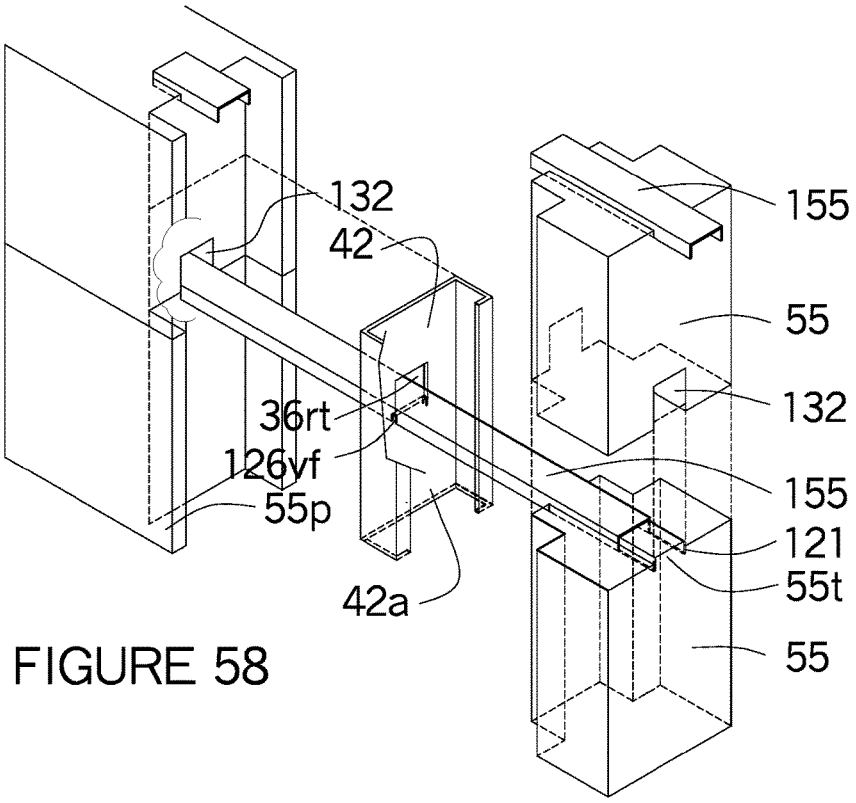
FIG. 58 shows an isometric view of the horizontal U channel turned downward having notches with the foam spacer having the tongue fitting into the horizontal bracing channel.
Figure 59:
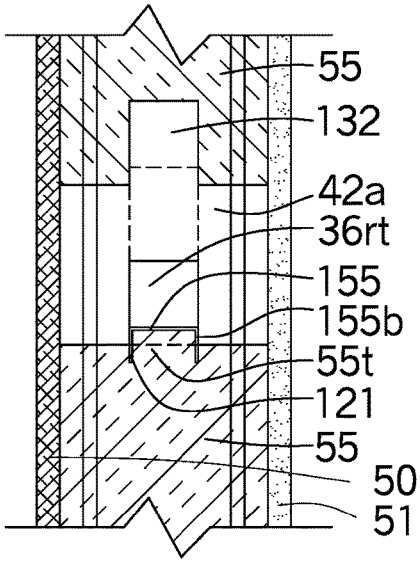
FIG. 59 shows a wall section with the horizontal U channel facing downward into the horizontal tongue with the inner and outer boards.
Figure 60:
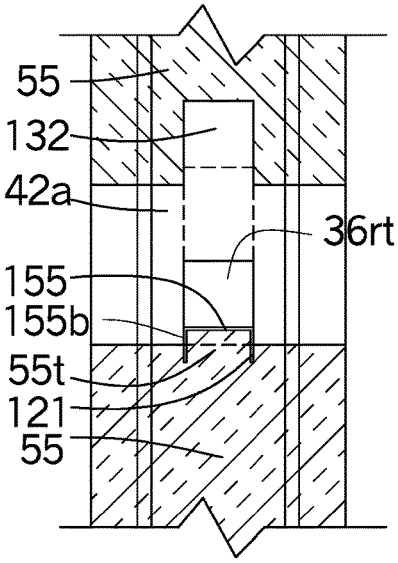
FIG. 60 shows a similar wall section as FIG. 59 except the overlapping projections of the foam spacer at the flanges.

FIGS. 58-60 shows a horizontal bracing channel as a horizontal U channel 155 facing downward as shown in FIG. 31-33 however here the flanges 155*b* have vertical-flange notches 126*vf* fit into the bottom edge of the rectilinear hole 36*rt*. A groove 121 is installed adjacent to the horizontal tongue 55*t* so the flanges 155*b* can fit into. The trough 132 is above the horizontal bracing channel and is large enough for the horizontal U channel 155 can fit into. FIG. 59 show the wall section with the inner and outer walls shown as rigid board 50 and rigid insulation 51 and FIG. 60 is shown with the projections 55*p*.

Figure 61:
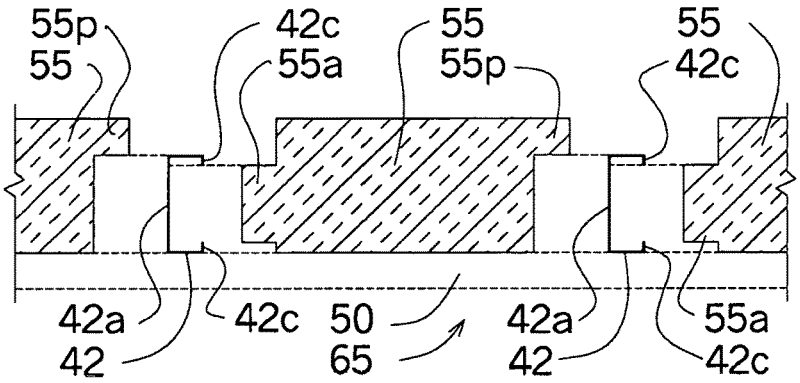
FIG. 61 shows a floor section of the foam spacer similar to FIG. 10.
Figure 62:
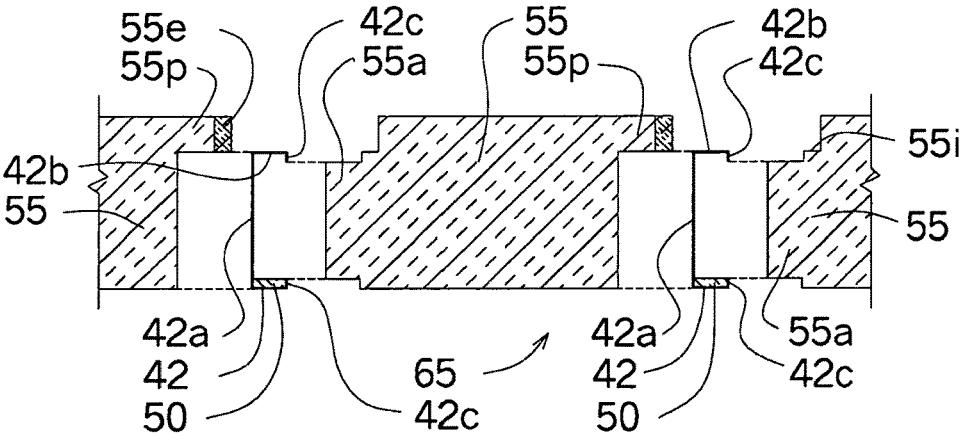
FIG. 62 shows a similar floor section to FIG. 61 with an extension added to the projection of the foam spacer.

FIG. 62 is a roof section or a wall section of the structural insulating core 111 shown in FIGS. 9, 10 & 34 and is similar to the plan view shown in FIG. 61 except the C channels 42 are shown horizontally where a floor joist or ceiling joist application would require deeper web 42*a*, since the structural capacity of the C channels 42 would typically require to have a greater strength. In FIG. 62 the wall panel 65 shows the foam spacer 55 to be the full depth of the C channels 42 and the foam spacers 55 fits against the webs 42*a* and against the lip 42*c* and rests on the rigid board 50. The opposite side of the foam spacers 55 rests against the web 42*a* of the adjacent C channel 42 and above the flanges 42*b*. FIG. 61 also shows that the projection 55*p* is longer similar to FIG. 58 where the foam extension 55*ex* is shown and is shown extending longer than the width of the flange 42*b* forming a greater thermal break in the foam spacer 55 and the C channel 42. The support channel in the structural insulating core can be formed with wood blocking 72 or the C channel 42.

Figure 63:
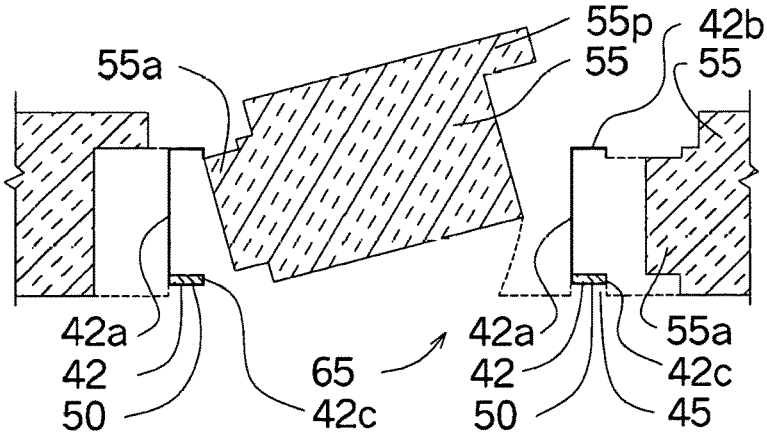
FIG. 63 shows the floor section sliding together with the support channels.

FIG. 63 is the same section as FIG. 62; however the bottoms of the foam spacers 55 are shown deeper than the C channels 42. The additional depth of the foam spacers 55 forms a gap 45 between the C channels 42 and a finished ceiling (not shown). In addition, the foam spacers 55 are shown sliding into position in the wall panel 65. Since the foam spacers 55 do not have a projection 55*p* on the underside of the foam spacers 55, the foam spacers 55 can slide into position after the C channels 42 have been installed instead of installing the C channels 42 at the same time as the foam spacers 55.

Figure 64:
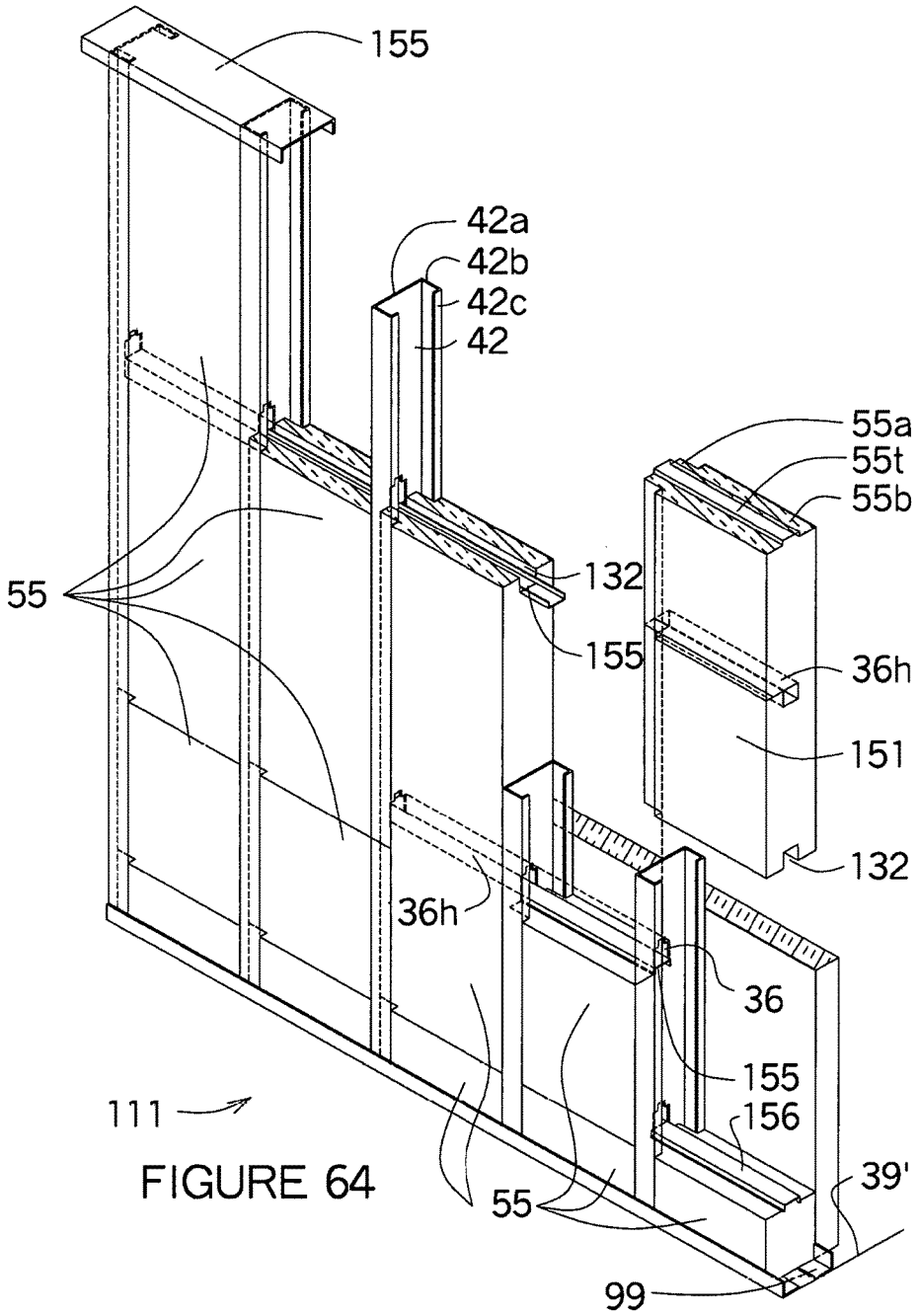
FIG. 64 shows the structural insulating core wall with horizontal bracing channels and longitudinal spacing-bracing members with grooves.

FIG. 64 shows an isometric view of the structural insulating core 111 where the depth of the foam spacers 55 are the same as the width of the support channels shown as C channels 42. Previous figures have shown the foam spacers 55 with different thicknesses, some overlapping and or protruding the C channels 42. The left side of the foam spacer 55 is referred to as the tongue shape 55*a* where the foam spacer 55 is installed against the lip 42*c* extending the depth of the flange 42*b* and abuts the web 42*a* of the C channel 42 and the opposite side or groove shape 55*b* of the foam spacer 55 abuts the web 42*a* of an adjacent C channel 42. Since not all foam spacers 55 may not want to extend the full height of the structural insulating core 111, the foam spacers 55 can abut between each other by connecting together the horizontal tongue 55*t* of one foam spacer 55 fits into a trough 132 of another foam spacer 55. The trough 132 can be the depth of the horizontal tongue 55*t* or can be extended deeper to allow of mechanical/utilities to pass through the trough 132 which is larger in size. The spacer blocks 55 shown in FIG. 64 uses different height foam spacers 55. A foam spacers 55 are shown at the concrete floor 39' between each of the support channels are short in height and all have a flat bottom with a horizontal tongue 55*t* on the top of the foam spacer 55. Two different types of horizontal bracing channels are shown; the upper horizontal bracing channels are shown as a horizontal U channel 155 with its flanges 155*b* extending upward from the web 155*b* with the exterior sides fitting into the trough 132 while the longitudinal spacing-bracing member shown as a reverse lip channel 156 is shown face down so the interior side fits onto the horizontal tongue 55*t* and the lips having notches engage the side edges of the hole 36. Both types of horizontal bracing channels pass through the holes 36 of adjacent support channels with the foam spacer 55 between the support channels. The adjacent foam spacer 55 also shows a medium height foam spacer 55 above between support channels and connected together with another horizontal U channel 155 on top of the foam spacer 55. All the foam spacers 55 have a trough 132 at the bottom that fits over the horizontal U channel 155 at the foam spacers 55 below. The foam spacer 55 above the first foam spacer 55 shows a horizontal hole 36*h* in the middle of the foam spacer 55 spanning the length of the foam spacer 55 between the support channels. The horizontal hole 36*h* is located where the adjacent foam spacers 55 have the horizontal bracing channel passing between foam spacers 55. The horizontal bracing channels can be installed on one foam spacer 55 and extended through the holes 36 of the C channels 42 and on to the horizontal tongue 55*t* of the adjacent foam spacer 55. The extending horizontal bracing channels only need to be secured to the horizontal tongue 55*t* a short distance, just enough to secure the adjacent foam spacers 55 on either side of the extending horizontal bracing channels. Horizontal bracing channels can be installed in short segments that is staggered every other foam spacer 55 just enough to secure the foam spacers 55 together. The foam spacer 55 can be reversed as discussed earlier that is with the trough 132 on top of the foam spacer 55 and the horizontal tongue 55*t* located at the bottom of the foam spacer 55. The horizontal holes 36*h* can be cut with a hot wire or can be molded with the hole 36*h* formed into the foam spacer 55 at the time of molding the foam spacer 55.

Figure 65:
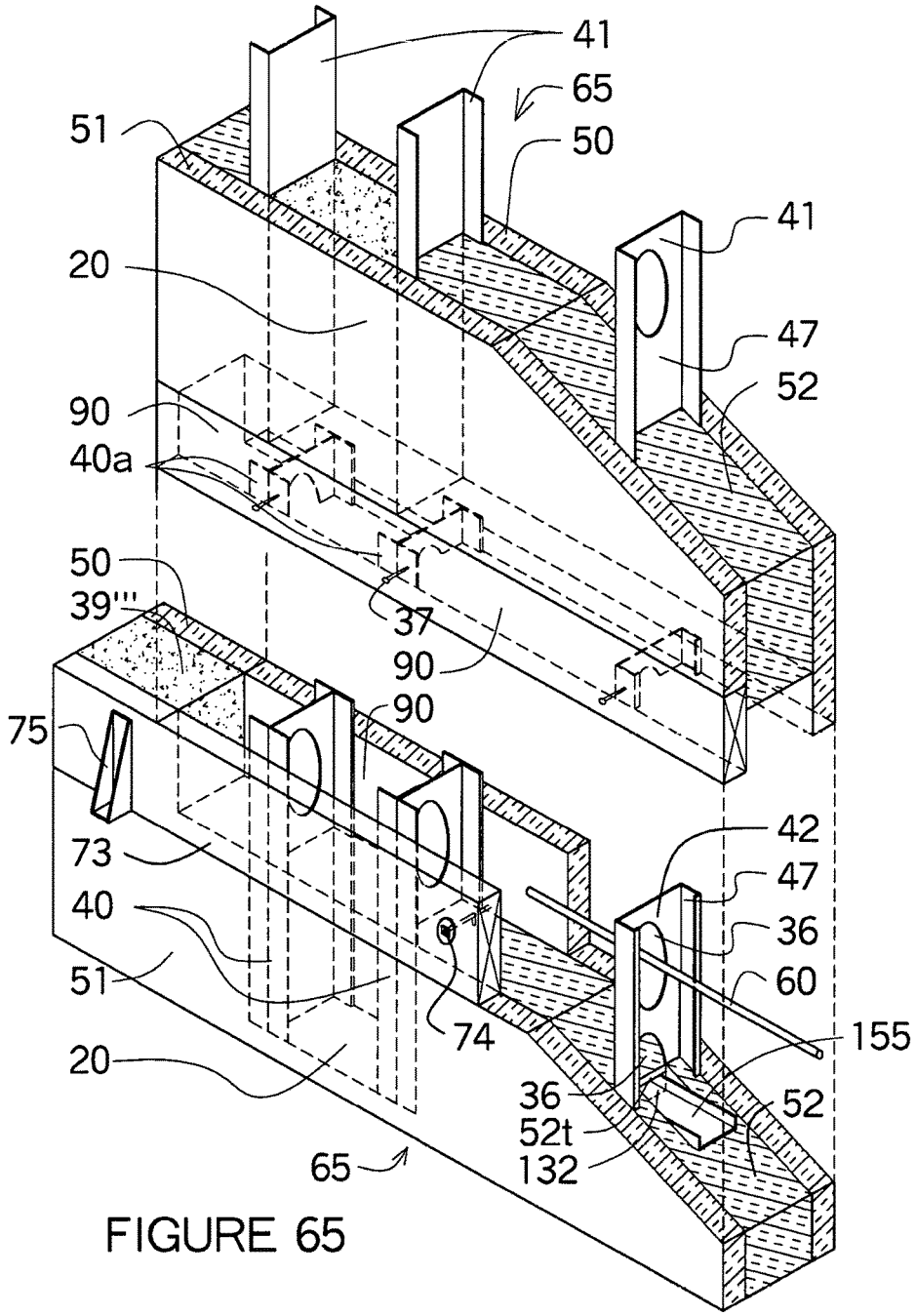
FIG. 65 is an isometric view of horizontal beam, column and another wall forming structure interlocking between each other as well as the horizontal bracing channel in the middle of the spacer insulation.

FIG. 65 is a wall section showing two wall panels 65 that is wall panel 65 is installed above another wall panel 65. The wall panel 65 consists of a rigid board 50 and rigid insulation 51 along with the spacer insulation 52 between the outer surfaces. The wall panel 65 is shown with a column mold 20 and horizontal beam mold 90 intersecting at the top of wall panel 65. In wall panel 65, the spacer insulation 52 is shown stopping at the bottom of the beam mold 90. The wall panel support channel shown as an H channel 40 forms column mold 20 then passes through the beam mold 90 then extending above the wall panel 65. The extension above the lower wall panel 65 is shown in ghost in the wall panel 65 and when wall panel 65 is resting above the lower wall panel 65, fasteners (not shown) connect the rigid board 50 and rigid insulation 51 to the H channels 40 of wall panel 65. Horizontal steel reinforcing 60 can be installed through the holes 36 in the H channel 40 at the beam mold 90 and at the spacer channel 47 of the beam mold 90. The wall panel 65 is shown with U channels 41 as supports for the column mold 20 and is used as a spacer channel 47 in the middle of the spacer insulation 52. The U channels are shown shorter at wall panel 65 above in order to allow for the column mold supports of H channels 40 to be secured with fasteners 37 through the rigid board 50 and rigid insulation 51 thereby connecting the two wall panels 65 together. The column mold 20 can be filled with concrete 39 prior to wall panels 65 being installed. The beam mold 90 can be filled with concrete 39 at the same time as the column mold 20 or the beam mold 90 can be filled with concrete 39 when the column mold 20 is filled with concrete 39. In wall panel 65, a wood ledger 73 is attached directly to the H channels 40 within the column mold 20 and the spacer channel 47. Anchor bolts 74 are attached directly to the wood ledger 73 and placed within the beam mold 90. The metal joist hanger 75 is attached to the wood ledger 73. A similar light gauge metal joist and metal ledger joist (not shown) can also be in lieu of the wood ledger. Another added feature is to install wood blocking 72 at a floor line or where horizontal support is required between panels as shown in wall panel 65. The lower portion of wall panel 65 shows a horizontal U channel 155 as the horizontal bracing along with the horizontal trough 132 and the horizontal tongue 55*t* also shown in FIG. 64.

Figure 66:
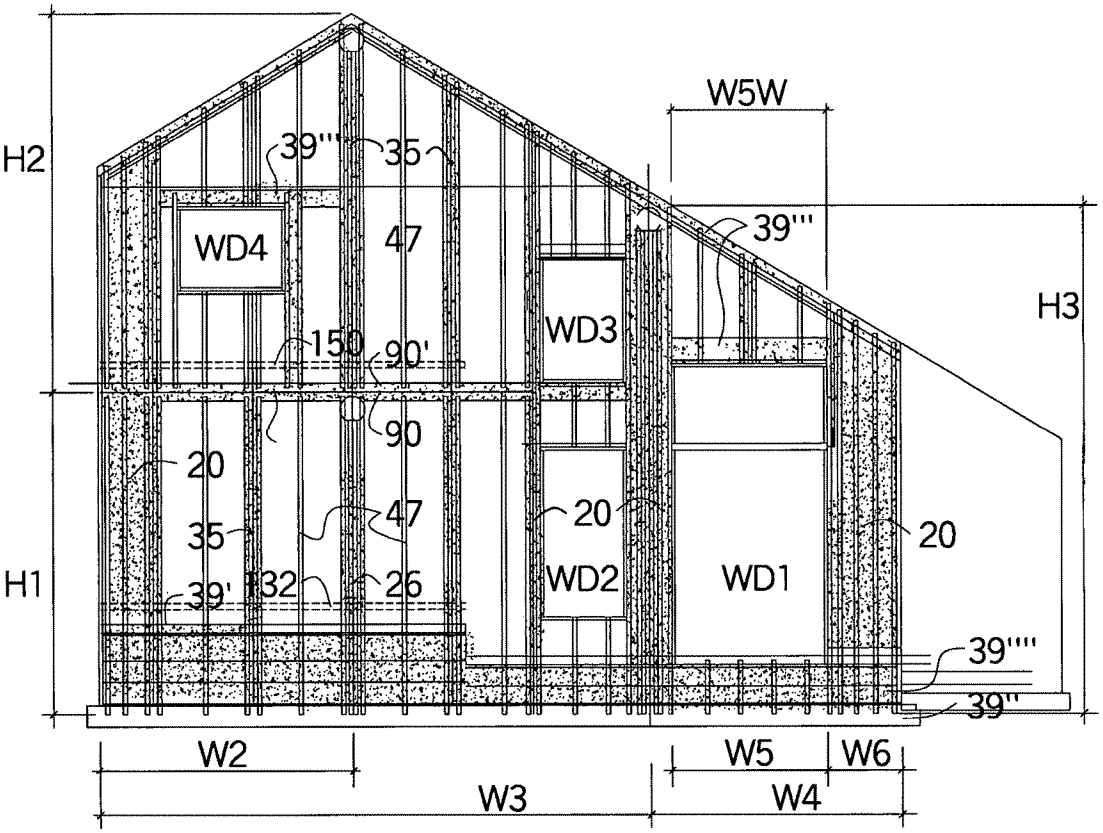
FIG. 66 shows a building elevation with various wall panels including concrete beam and wall molds configurations with intermediate spacer channels between the column molds, corner L shaped column molds at the corners of the wall forming structure.

FIG. 66 shows a building elevation with various wall panels of concrete beam and column molds configurations (shown dotted) with intermediate support channels between the column molds. When constructing a building using wall panels, each wall panel requires a different number even though the wall panels are a variation of the previously described wall panels 65. The wall panels shown in this drawing can be as narrow as 4'-0" wide shown as W1 to intermediate panel widths shown as W2 to full width walls shown as W3. The height H1 of any of the W1, W2 or W3 wall panels could be from the footing 39", including the concrete foundation 39"" to the beam mold 90 at the second floor. Wall panels are sometimes manufactured from column centerlines or from large window jambs depending on the size of the windows. The wall panel W4 is shown in the middle of column mold 20 to the end of the wall mold 32 and extending from the footing 39", including the foundation 39'" to the roof referring to height H3. On the other hand, smaller sections like a foundation wall panel W5 is easier to handle without using a crane (not shown) to install the foundation wall panel W5. Another example would be wall panel W6 as part of an L column mold 20 or a window header mold W5W which incorporated a concrete beam 39'" at the roof line as well as above the door/window WD1. The interlocking panel connection shown in FIG. 65 is shown at the beam molds 90. On the other hand, the wall panel W2 could be two stories high by making the panel heights H1 and H2 as all one panel height. This particular building showed the concrete columns 35 close together, therefore there are not many spacer channels 47. An entire building could be built using only spacer channels 47, as shown in previous figures or in combinations with the column and beam molds 20 & 90. The column mold 20 is shown wider as it depends on the spacing between window/door WD1 & WD2 as well as any floor or roof beams that would affect the size of the column mold 20. The column mold 20 shown at the left and right corners of the building are wider due to wind loads or other structural conditions. Since a concrete beam 39''' is located between the building floors above, a window header like a concrete beam 39''' is not required. The wall panels 65 show the horizontal trough 132 with the horizontal bracing channel are both shown in ghost, however any of the support channels, holes, horizontal bracing channels can be used as well as the foam spacers 55 and spacer insulations 52 can be used.

Figure 67:
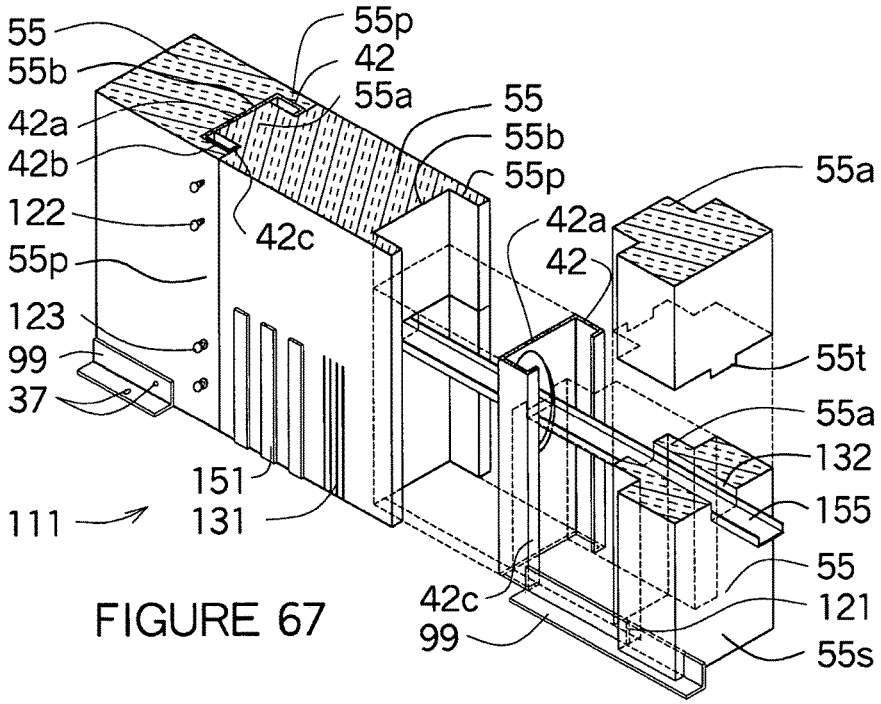
FIG. 67 shows the tongue and groove assembly at the structural insulation core.
Figure 68:
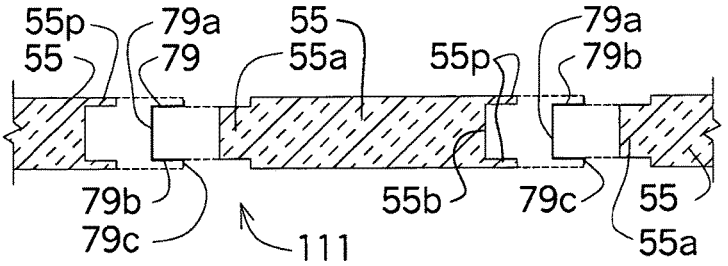
FIG. 68 shows a plan view with the tongue and groove assembly using the reverse lip channel at the structural insulating core.
Figure 69:
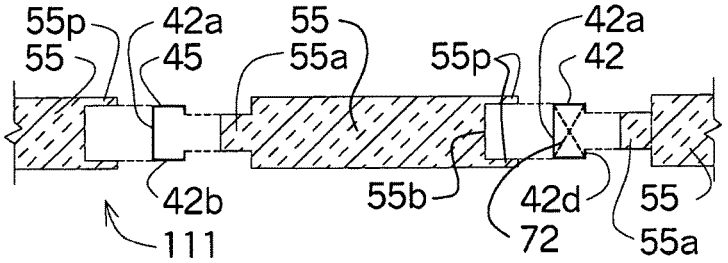
FIG. 69 show a plan view with the tongue and groove assembly using the C channel at the structural insulating core.
Figure 73:
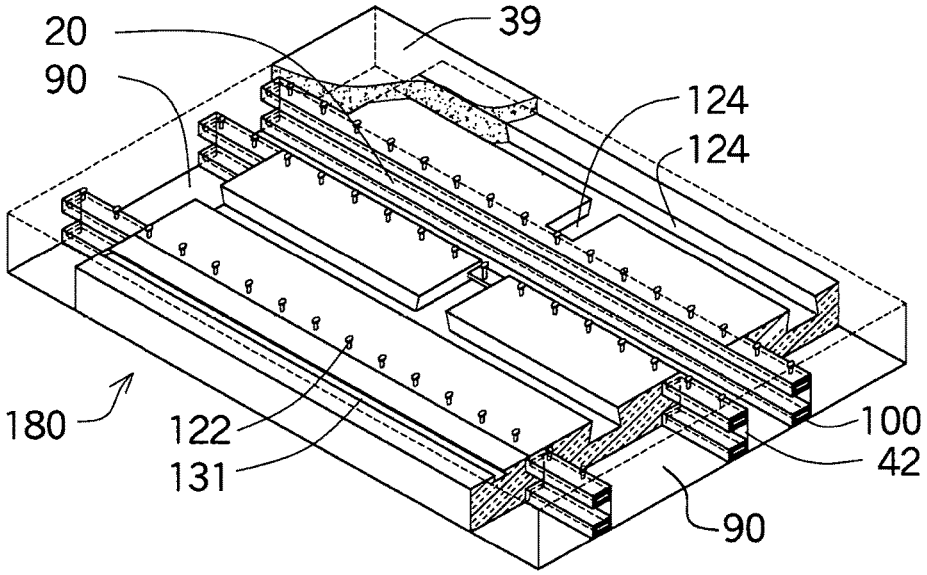
FIG. 73 shows an isometric view of precast wall mold when the concrete is poured over the structural insulating core.

FIG. 67 shows an isometric drawing of the structural insulating core 111 consisting of two C channels 42 and four foam spacers 55 that are wider than the C channels 42. The foam spacer 55 between the C channels 42 abuts the web 42*a* at the tongue shape 55*a* of the foam spacer 55 and the foam spacer 55 abuts the lip 42*c* at the C channel 42 on the left. The opposite end of the foam spacer 55 has the groove shape 55*b* where the web 42*a* of the C channel 42 fits into. Since the foam spacers 55 are wider than the C channels 42 the excess foam spacer on both sides of the C channel 42 forms a projection 55*p* that overlaps both flanges 42*b*. The tongue and groove configuration shows how the foam spacers 55 can easily fit together between the C channels 42. The projections 55*p* of the foam spacers 55 can easily be screwed or glued to the C channels 42. The webs 42*a* can easily be glued to the foam spacers 55 creating a stronger structural insulating core 111. FIG. 68 also shows the foam spacers 55 and C channels 42 in a separated position prior to securing the foam spacers 55 together creating a structural insulating core 111. In FIG. 69 the C channel 42 can be wood blocking 72, however the tongue shape 55*a* is not required in the foam spacer 55. The structural insulating core 111 can be used as an independent wall; an interior core for of the columns and beam molds previously described; and as a forming structure in a precast wall which is described in FIGS. 44 & 73-74. A screw 122 and double headed fastener 123 are shown secured through the foam spacer 55 at the projection 55*p* or into the insulating foam 100 to connect precast concrete walls to the structural insulating core 111 shown in FIG. 73-74. Attaching the screw 122 and/or the double headed fastener 123 to the structural insulating core 111 provides as thermal break with the C channels 42 as well as providing a means of securing a structural insulating core 111 to concrete as shown in FIG. 73. Also shown are drainage channels 151 that protrude from the structural insulating core 111 to create an air space should it be required when some exterior surface finish materials (not shown) are applied over the structural insulating core 111. In addition a recessed groove 121 is shown on the exterior face of the structural insulating core 111 to allow water drainage between the structural insulating core 111 and various stucco applications. Since the structural insulating core 111 is a solid wall, two methods are shown to secure the structural insulating core 111 to a floor 175. Base plate angle 99 is shown attached to the C channel 42 at the flange 42*b* and the floor 175; however a groove 121 is cut into the structural insulating core 111 at the base plate angle 99. Another method is to install the base plate angle 99 on the surface of the structural insulating core 111 and connect to the flange 42*b* of the C channel 42 using a fastener 37 and thereby having a thermal break between the C channel 42 and the base plate angle 99. A trough 132 is shown in the middle of the structural insulating core 111 and is aligned with the holes 36 of the C channel 42 for use as an electrical chase within the structural insulating core 111. In some cases the trough 132 is required to be metal channel (not shown) for compliance with some electrical codes. In addition, the trough 132 can be used to install a horizontal bracing channel shown as a horizontal U channel 155 connecting the C channels 42 within the structural insulating core 111. Usually the holes 36 within the C channels 42 are spaced 24" apart so the trough 132 could be installed to align with the holes 36 therefore making the foam spacers 55 be shorter pieces rather than the full height of the wall. The horizontal U channel 155 is shown within the trough 132 passing through the holes 36 within the C channels 42 and into the adjoining spacer insulation 55. The C channels 42 and the horizontal bracing channel can also be shorter in length and used as brackets to secure four adjacent spacer insulations 55 together. When the four short foam spacers 55*s* intersect the horizontal tongues 55*t* of two short foam spacers 55*s* fit into the troughs 132 of the two short foam spacers 55*s* below; plus the horizontal bracing channel connects the two short foam spacers 55*s* together as well as the C channel 42 because the horizontal U channel 155 has a hole 36 in the web 42*a* locking the C channel 42 with the tongue shape 55*a* and the groove shape 55*b* together. The short foam spacers 55*s* can be installed together without support channels since the tongue shape 55*a* and the groove shape 55*b* interlock between short foam spacers 55*s* as well as the horizontal U channel 155 within the troughs 132 plus the horizontal tongues 55*t* fitting into the troughs 132 together form a structural insulating foam core wall.

FIG. 68 shows a plan view of FIG. 67 except here two reverse support lip channels 49 are used between three foam spacers 55. The reverse support lip channel 49 is similar to the C channel 42 in FIG. 7, except the lip 49*c* is bent in the opposite direction as the lip 42*c*. The tongue shape 55*a* fits against the web 49*a* of the reverse lip support channels 49 and the groove shape 55*b* fits against the adjacent reverse lip support channel 49 at the web 49*a* and the projection 55*p* of the foam spacer 55 fits against the flanges 49*b* and abuts the lip 49*c*. Since the structural insulating core 111 has a snug fit between the reverse lip support channels 49 and the foam spacers 55, the wall panel can be glued together. The reverse lip support channel 49 and the C channel 42 have the same physical characteristics since the lip 49*c* & 42*c* function in the same way giving the reverse lip support channel 49 the same strength as the C channel 42. In addition, the reverse lip support channel 49 can smaller and use as a horizontal bracing channel where ever it has been used.

FIG. 69 is similar to FIG. 1 except the three foam spacers 55 of the structural insulating core 111 have projections 55*p* that overlap the flanges 42*b* of the C channel 42 also shown in FIG. 67. The foam spacers 55 extends beyond the webs 42*a* of the adjoining C channels 42 enough to create a thermal break and cover the C channels 42 with the same projection 55*p*. The open portion of the C channel 42 has a lip 42*c* where the tongue shape 55*a* fits between and a horizontal bracing channel (typically used to connect adjacent C channels within the building industry) plus the opposite end of the foam spacer 55 also fits between the webs 42*a* of the adjacent C channel 42. Since the foam spacer 55 overlaps and fits between the webs 42*a* of the C channel 42, the projection 55*p* and the foam spacer 55 are wall insulations as well as a wall sheathing material, both the foam spacer 55 and a wall sheathing material can all be made together as one material. FIG. 69 is a plan view of the wall panel shown in FIG. 67 with the tongue shape 55*a* and groove shape 55*b* and the projection 55*p* of the foam spacer 55 between the C channels 42. In FIG. 69 wood blocking can be used to replace the C channel 42, however the tongue shape 55*a* of the foam spacer 55 and the horizontal bracing channel are not required.

Figure 71:
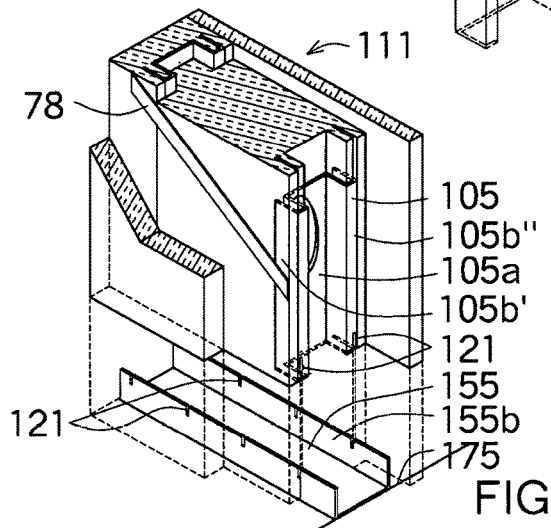
FIG. 71 shows the base plate at the floor with grooves in the flanges connecting to the support channels.

FIG. 71 is an isometric view structural insulating core 111 showing the double flange channel 105 being attached to a standard base plate shown as a horizontal U channel 155 typically used in light gauge metal framing. The horizontal U channel 155 is attached to the floor 175, and the double flange channel 105 is connected to the flange 155*b* of the horizontal U channel 155. The base plate, however is different because the horizontal U channel 155 has a groove 121 cut in the flange 155*b* and another groove 121 in the double flange channel 105 at the returning flange 105*b*" and these grooves 121 are cut 16' & 24" OC in the base plate in order to easily attached them together without measuring. Also the horizontal U channel 155 is wider than width of the web 105*a* of the double flange channel 105. The groove 121 is in the middle of the returning flange 105*b*" and corresponds to the groove 121 in the double flange channel 105 and the groove 121 in the foam spacer corresponding to the base plate. The wider base plate and the wider spacer insulation creates a thermal break between the flanges 105*b*' and 105*b*'" of the double flange channel 105. Now only the grooves 121 come in contact with the turning flange 120*b*" of the horizontal U channel 155. In addition, diagonal bracing 78 is shown installed on the surface of the foam spacer 55 connecting the array of double flange channels 105.

FIG. 73 shows an isometric view of the precast mold 180 where the concrete 39 is poured on top of the structural insulating core. Any of the previous described structural insulating cores 111 with either the spacer insulations, foam spacers 55 or supporting channel configurations can be used to form a precast mold 180. The previously described wall molds were first erected vertically then the hardenable material was poured into the wall molds, that is into the column and beam molds, while here the precast molds are laid horizontally and then the hardenable material is installed into the molds. The structural insulating core shown here is similar to FIG. 71, however the rigid board 50 is not required and concrete 39 is used instead as the exterior wall material. The rigid insulation 51 shown in FIG. 71 can be used as the bottom of the precast mold 180 or a forming bed typical used in precast construction can be used. The C channels 42 of the structural insulating core is shown extending into a beam mold 90 at the ends of the wall panel. The insulating foam 100 fits over the C channel 42 at the bottom of the beam mold 90 so drywall (not shown) or other materials can be attached after the concrete 39 has cured. Screws 122 or double headed fasteners (not shown) are attached through the structural insulating core into the C channel 42. In addition a recessed groove 121 is installed to additionally secure the structural insulating core to the concrete 39. Also additional strength can be added to the wall panel by installing a rib 124 parallel to the C channel 42 and another rib 124 can be installed perpendicular to the C channel 42 in the structural insulating core. The ribs 124 add additional strength to the concrete 39 allowing the C channels 42 to be spaced further apart. The precast mold 180 is complete when the wall panel form side boards (not shown) are installed. Additional steel reinforcing (not shown) is installed in the beam molds 90 and the column mold 20 and concrete 39 is poured over and into the precast mold 180 when the precast mold 180 is in a horizontal position. Since the concrete 39 passes through the holes 36 (not shown) in the C channel 42 of the beam mold 90, the C channel 42 is secured to the structural insulating core. In addition, ribs 124 and grooves 121 are also installed on the structural insulating core to add additional bonding strength to the concrete 39 bonding to the structural insulating core. When the ribs 156*r* and recessed grooves 121 are added to the structural insulating core, the screws that are secured to the C channel 42 might not be required to secure the concrete 39 to the structural insulating core. Many of the other previously described wall molds or structural insulating cores can also be used to form the precast mold 180.

Figure 74:
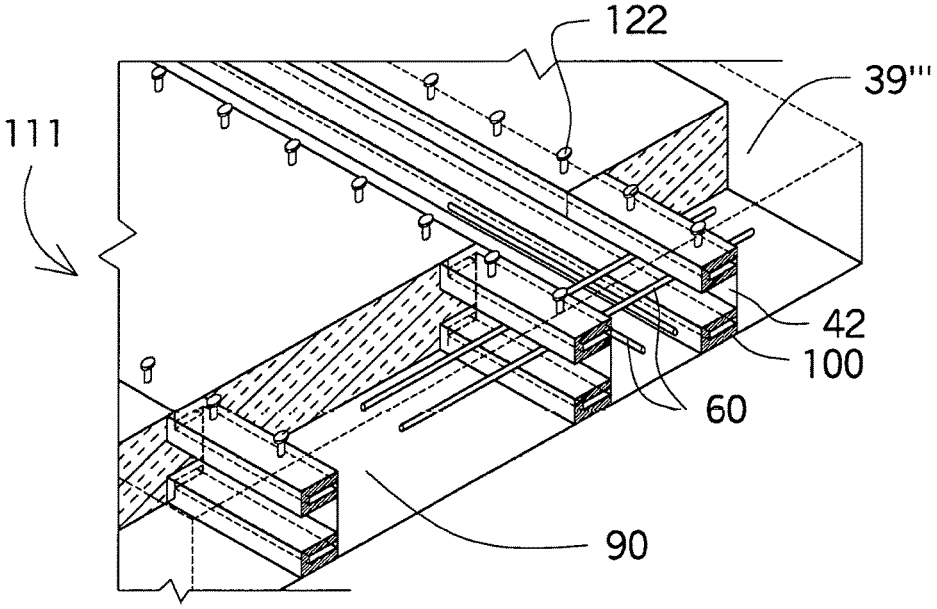
FIG. 74 shows and enlarged view of the column and beam in the precast wall when the concrete is poured face up.
Figure 79:
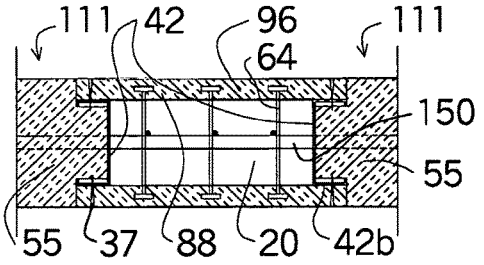
FIG. 79 shows a plan view of an ICF mold between two structural insulating cores forming a concrete column.
Figure 78:
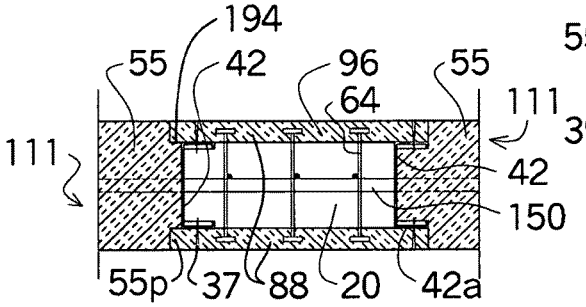
FIG. 78 shows a plan view of an ICF mold between two structural insulating cores forming a concrete column.
Figure 77:
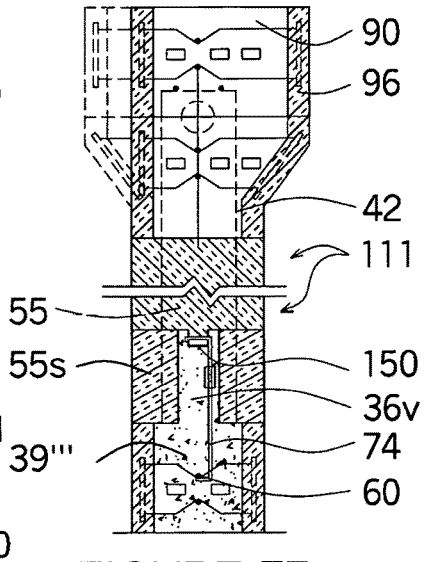
FIG. 77 shows a wall section with the structural insulating core and an extended ICF block mold forming a wide concrete beam.
Figure 75:
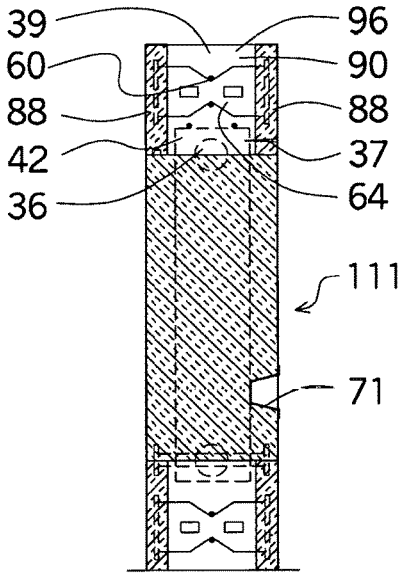
FIG. 75 shows a wall section with the structural insulating core and the ICF mold forming a concrete beam.
Figure 76:
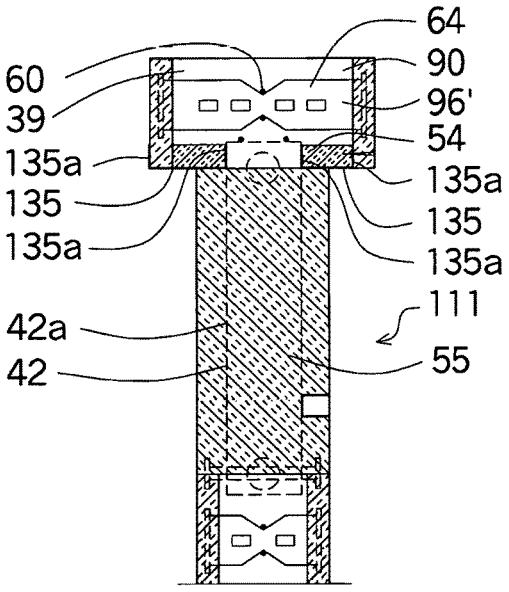
FIG. 76 shows a wall section with the structural insulating core and a larger ICF mold forming a wide concrete beam.

FIG. 74 through FIG. 79 shows various configurations of the ICF block molds 96 attached to the structural insulating core 111. In FIG. 74 is a wall section showing the beam mold 90 is placed above to the structural insulating core 111. The C channel 42 with holes 36 extending into the beam mold 90 and attached with a fastener 37 through the rigid foam block faces 88 of the ICF block mold 96. When concrete 39 is poured into the beam mold 90, the C channel 42 will be secured into the concrete 39. In addition a horizontal bracing channel can be installed as part of the structural insulating core 111. The horizontal bracing channel would be installed between the typical connector 64 of an ICF block mold 96 and therefore would be installed between one ICF block mold 96 and an adjacent ICF block mold 96 (not shown) connect the connectors 64 of the respective ICF block molds 96.

Figure 80:
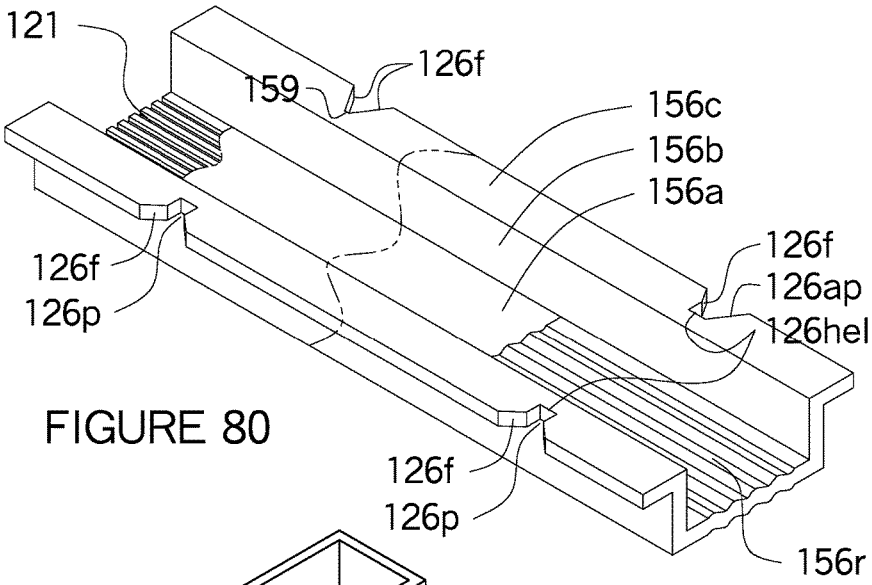
FIG. 80 is an isometric view of the reverse lip channel with a pair of notches including flares at each lip for engaging a least two support channels.
Figure 81:
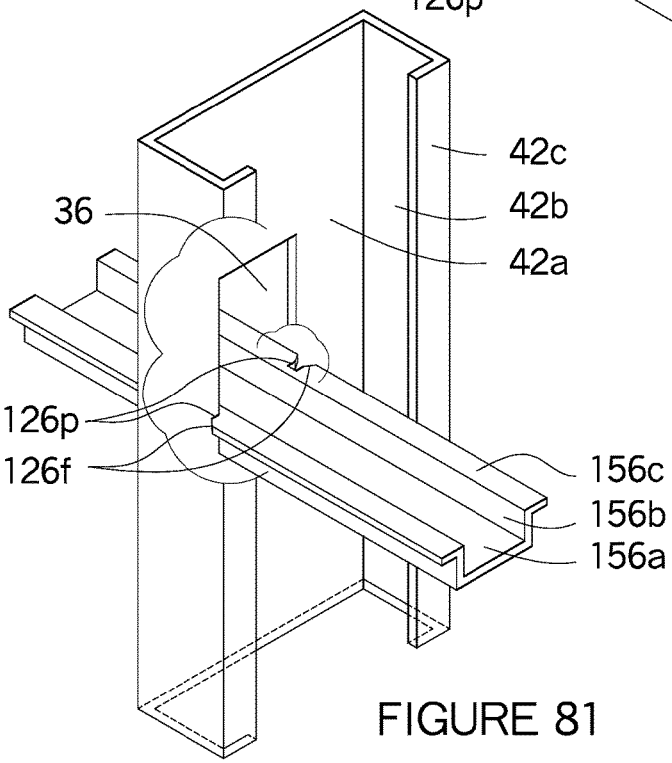
FIG. 81 is an isometric view of a C channel in FIGS. 1,6, & 9 with the horizontal reverse lip channel of FIG. 8 in the C channel, the notches of the horizontal reverse lip channel engaging the side edges of the hole in the web of the C channel.
Figure 82:
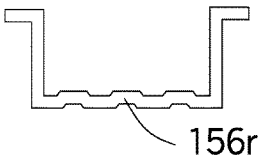
FIG. 82 shows a cross section through the longitudinal spacing-bracing member at the rib impressions.

FIG. 80 shows an longitudinal spacing-bracing member as a horizontal reverse channel 156 having an elongated web 156*a* with first and second parallel edges being connected and extending away from the web 156*a* forming first and second longitudinal walls are shown as flanges 156*b*. The flanges 156*b* are bent inward with longitudinal lips extending away from longitudinal shown as lips 156*c*. The free side edges of the lips 156*c* having lip notches 126*p* cut inward from the free side edges. At the free side edges of the lips 156*c* a flare 126*f* is shown at the lip notches 126*p* to form a wider opening into the lip notches 126*p*. At one lip notch 126*p*, the flares 126*f* at the side edges have a blunt edge 159. Various types of configurations or impressions can be installed with the longitudinal spacing-bracing member like ribs 156*r* (shown in elevation in FIG. 82) and recessed grooves 121 (shown in elevation in FIG. 83) which both are shown having an internal side and an external side. I believe the ledges 79 are described in the next four (4) USPTO pending applications. In FIG. 81 the lip notches 126*p* and the flares 126*f* occur on both side edges of the lip 156*c* when the reverse lip channel 156 is installed into a hole 36. Since the lips 156*c* are wider than the width of the hole 36, the longitudinal spacing-bracing member is tilted at an angle so the lips 156*c* can pass into the hole 36. As the lips 156*c* pass along the side edges of the hole 36, the flare 126*f* having its sides angular, that is the flare 126*f* is wider than the lip notches 126*p*, will force the horizontal reverse lip channel 156 by gravity into the flare 126*f* and will force the lip notches 126*p* to rotate and engage into the side edges of the hole 36. The longitudinal spacing-bracing member will be secured into the hole 36 when the side edges of the lip notches 126*p* engages the planar sides of the web 156*a* in the web 42*a*. On the other hand, the lip notches 126*p* can be angular as some holes 36 are manufactured as punched holes 169 which have a rim 36*r* around the hole 36 that is angular similar to the rim 36*r* as shown in FIG. 15. The rim 36*r* is sometimes referred to as a ledge 79.

Figure 83:
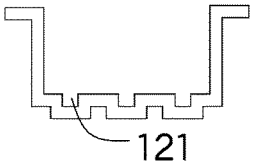
FIG. 83 shows a cross section through the longitudinal spacing-bracing member at the recessed grooves.

In FIG. 83 the web 156*a* is shown having three grooves 121 protruding into the web 156*a* and three ribs 156*r* protruding outward from the bottom side of the web 156*a*. However if the grooves 121 were deeper the three grooves 121 would be considered to have 13 sides. Obviously by installing one large groove in the web 156*a*, the web 156*a* would then be considered to have 5 sides (three horizontal sides and two vertical sides. The web 156*a*, longitudinal sides 156*b* and lips 156*c* can also have additional sides even though it would still be considered a reverse lip channel 156. Many different shapes are presently being manufactured with additional profile bends in the web, flanges and lips whether a U shaped channel 155 or the reverse lip channel 156 to increase the strength of metal channel framing. In FIGS. 80-83, the notches and flares 126*f* in the longitudinal spacing-bracing member can have various widths, depths, lengths, flares or angles of notches at its open end of the lips. In addition, the longitudinal spacing-bracing members can be inverted that can change the appearance and function. Sometimes the lip notches 126*p* could be connecting two crossing members within the same lip notches 126*p*. If the horizontal loading of a support member has extensive wind pressure in one direction, then a longer lip notch 126*p* would be required may be eliminating the flare edges 126*f* and extending the notches into the longitudinal sides and even the web. You might have to increase the lip 156*c* strength by forming a double lip edge. Sometimes a longer length of the notch is required due to excessive horizontal loading in one direction making one side edge longer that the other side edge or one side could have a flare edge 156*f* and the opposing side does not have a flare. The longitudinal spacing-bracing members can be installed in the support members at an angle through the holes 36. The width of the lip notches 126*p* would be wider as they pass through the hole 36 at an angular lip notch 126*ap* and the lip notches 126*p* might have to be cut at an angle for an easier installation or may be just eliminate the parallel side edges of the lip notches 126*p* and just have the flare edge notch 126*f* converge to a point. Manufacturing is that easy there will also be a blunt end 159 at the converging point to secure the crossing member into the lip notch 126*p*. The flare edge notch 126*f* will probably only be strong enough to temporarily secure the longitudinal spacing-bracing member until drywall is secured, but is still better than the embossed dimples used presently to secure the longitudinal spacing-bracing members together. Another aspect of the invention is whether the longitudinal spacing-bracing member has the U-shape facing upward or downward or whether the lip notches 126*p* extend into the longitudinal sides 156*b* and/or web 156*a* or are aligned with the side edges of a key hole 36*k*. The longitudinal spacing-bracing members with their notches reduce lateral and or vertical movement. Various types of hole configurations and longitudinal bracing-spacing orientations can also be used to form many different lip, web and longitudinal notches combinations.

Figure 84:
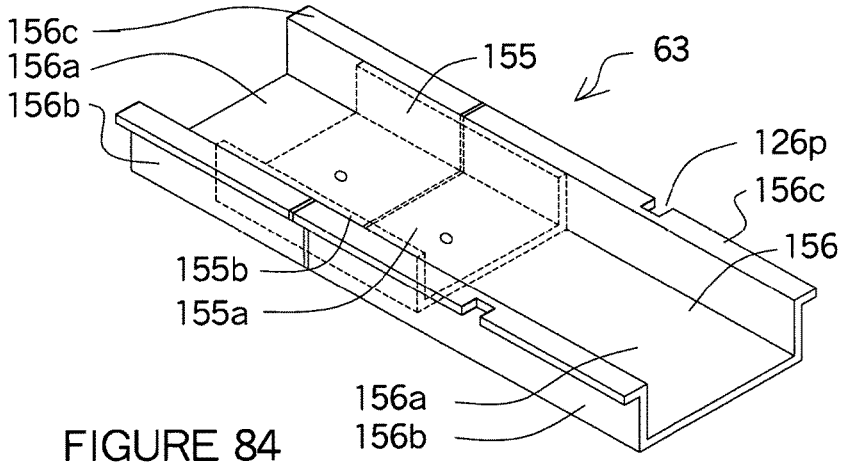
FIG. 84 is an isometric view of a U channel coupling inserted in the open channel of two horizontal reverse lip channels.
Figure 85:
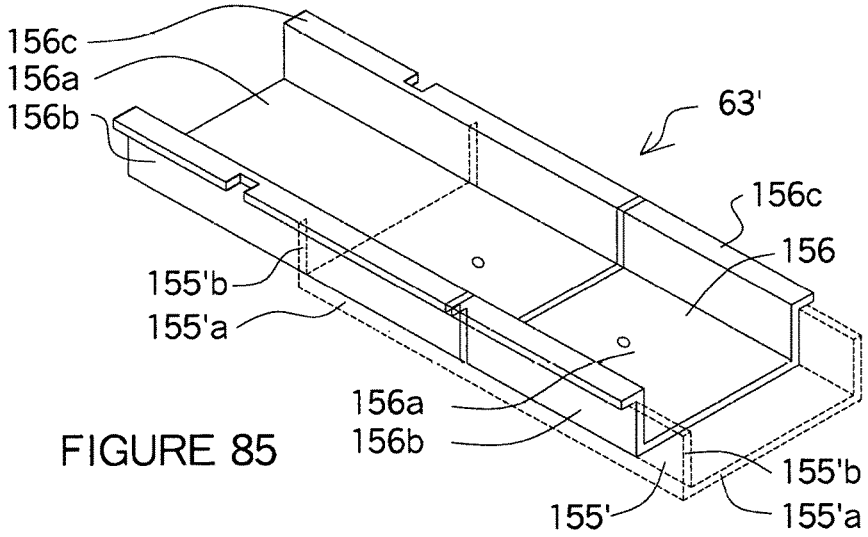
FIG. 85 is an isometric view of a U channel coupling where two horizontal reverse lip channels are inserted into the open channel of the coupling between the flanges and web of the U channel coupling.

FIGS. 84 & 85 are similar in that a horizontal U channel 155 is used as a coupling 63 and 63' that connects two longitudinal spacing-bracing members shown as horizontal reverse lip channel 156. In FIG. 84 the longitudinal spacing-bracing member shown as a horizontal reverse lip channel 156 has the interior side of the web 156*a* and the flanges 156*b* of both horizontal reverse lip channels 156 facing upwards. The interior side of the coupling 63 comprises the open side of horizontal U channel 155 having the exterior side of the web 155*a* and flanges 155*b* being inserted into the interior side, the open side, of the horizontal reverse lip channels 156 where the web 155*a* of the horizontal reverse lip channels 156. In FIG. 85 the interior side of the coupling 63' comprises of the open side of the horizontal reverse lip channel 156 and the horizontal U channel 155'. The exterior side of web 156*a* and the flanges 156*b* are received in the open side, the interior side, of U channel 155' so the exterior side of the web 156*a* is juxtaposed against the interior side of the web 155'*a* of the horizontal U channel 155'. The horizontal U channels 155 and 155' are secured to the horizontal reverse lip channels 156 with metal screws, nut and bolts, or like fixtures.

Figure 86:
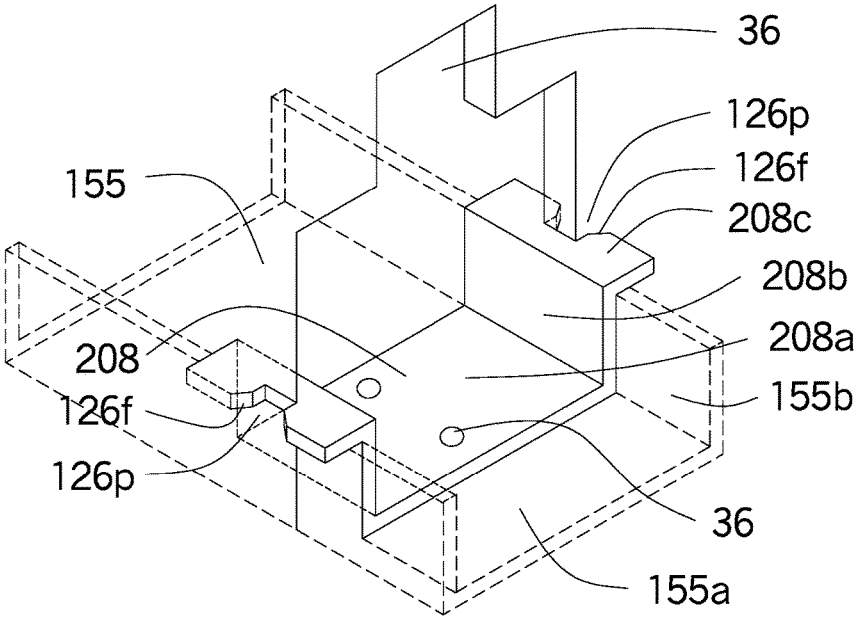
FIG. 86 shows a one piece multi-plane bracket having a bottom side, two vertical sides with notches at the horizontal lips engaging the hole of the support member install between the webs of a bracing member being U shaped with the web of the bracket fasten to the bracing member.
Figure 87:
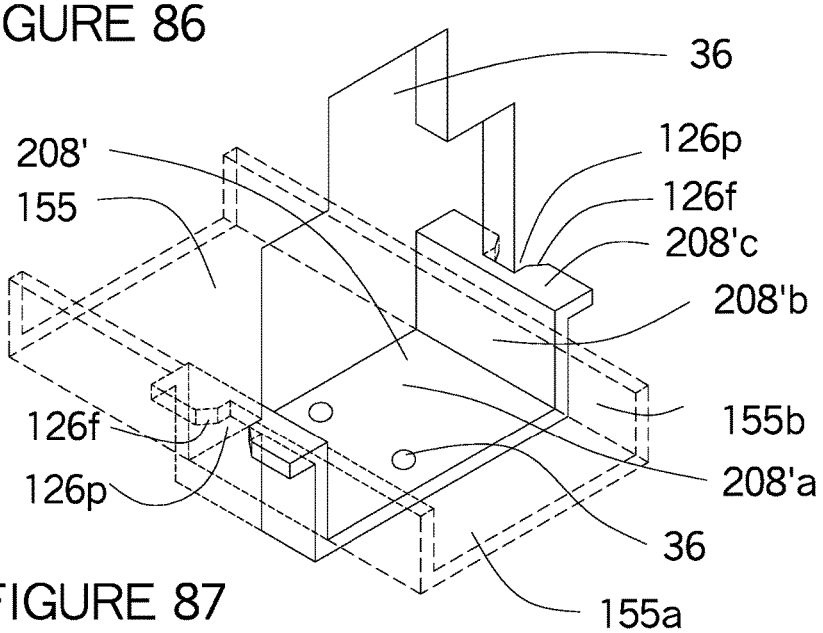
FIG. 87 is the same as FIG. 86 except the one piece multi-plane bracket shown as a reverse lip shape with notches at the lips is installed in the hole of the support channels first and the bracing member being U shaped facing upwards is installed between the flanges of the bracket.

FIG. 86 shows the horizontal bracing channel as a horizontal U channel 155 where the interior side is facing upwards typically spanning between the holes 36 in the support channels shown as C channel 42. A multi-plane bracket 138 is shown in FIG. 18, but is shown here as a multi-plane bracket described as a reverse lip bracket 208 having the exterior side fitting between the interior side of the flanges 155*b* of the horizontal U channel 155 so that the lip notches 126*p* on both sides of the lips 208*c* engage the side edges of the hole 36 and extend past the edge of the hole 36 along with the flares 126*f* that are angled. The flares 126*f* are angled so the reverse lip bracket 208 can glide into the side edges of the hole 36 easily as the reverse lip bracket 208 is inserted in a vertical orientation and then rotated into a horizontal orientation so the lip notches 126*p* engage the side edges of the holes 36. The horizontal bracing channel and the reverse lip bracket 208 are additionally secured by fasteners between the webs 155*a* & 208*a* thereby securing the horizontal bracing channel, the reverse lip bracket 208 and the hole 36 together at the support channel. The multi-plane bracket 138 can also be used to connect two horizontal bracing channels together. FIG. 87 is similar to FIG. 86, however the reverse lip bracket 208 shown with its lip notches 126*p* are installed in the hole 36 of the support channels first, then the web 155*a* of the horizontal U channel 155 are installed between the two parallel flanges 208*b* of the reverse lip bracket 208 are secured together at their webs 155*a* & 208*a*. The multi-plane bracket 138 is rotated into the hole 36 with the lip notches 126*p* engaging the side edges of the hole 36. The reverse lip bracket 208 and the horizontal U channel 155 can be reversed, where the interior sides are turned downward so the web 155*b* & 208*b* extend downward from the web 155*a* & 208*a*. The horizontal U channel 155 in both FIG's can also be a reverse lip channel 156 that has the lip 156*c* with the lip notch 126*p* at the free end and a reverse lip bracket 208 can also be a reverse lip channel 156. When the reverse lip channels 156 overlap each other, the notches at the end of each reverse lip channel 156 intersect the same hole and the lip notches are indented from the ends. In addition a reverse lip channel 156 with sloped flanges and lip notches can fit into or over another reverse lip channel 156 with rectilinear flanges and lip notches.

FIG. 88 is described in Provisional Application U.S. 61/628,044 dated Oct. 24, 2011 and attached to this patent application in quotation marks: "FIG. 112 shows several metal floor joists 176*b* that can form a wall or roof system and being connected by joist straps (shown in ghost) which have been used to stabilize metal floor joists 176*b* from turning or twisting. C channels 42 are used as the metal floor joists 176*b* in FIG. 112. The holes 36 are oriented vertically so the reverse lip channel 79 passes through the web 42*a* in a horizontal position, that is the notches 79*n* in the reverse lip channel 79 are installed in a horizontal position. On the other hand, when the hole 36 is oriented horizontally the reverse lip channel 79 is oriented vertically so the lips 79*c* are projected vertically as shown in FIG. 114. In addition, the reverse lip channel 79 does have to be installed in shorter segments; a coupling can be used to connect two reverse lip channels 79 together. The coupling can be U shaped of a flat plated within the reverse lip channel 79 between the two flanges 79*b* and against the web 79*a*; or another reverse lip channel 79 that has a smaller web 79*a* along with longer lips 79*c* in order to fit within the reverse lip channel 79; or lastly just a U channel that is larger that fits around both of the reverse lip channels needing a coupling. The hole 36 in a horizontal position shows the horizontal bracing channel 150 passing through the holes 36 of the metal floor joists 176*b*, however the horizontal bracing channel 150 has notches 150*n* in the flanges 150*b* that fit into the holes 36 of the metal floor joists 176*b*. The notches 150*n* do not extend the full depth of the flange 150*b* so the flange 150*b* has part of the flange 150*b* still connected to the web 150*a*. The flange 150*b* can be cut full depth, but when doing so allows the horizontal bracing channel 150 can bend easier when placing the horizontal bracing channel 150 into place. By installing the notches 150*n* in the horizontal bracing channel 150, the metal floor joists 176*b* will not bend or twist easily and the horizontal bracing channel 150 supports the foam spacer 55 as well as providing additional support for the foam spacers 55 as shown in FIG. 114."

FIG. 88 shows several C channels that can form a wall or roof system and being connected by joist straps (shown in ghost) which have been used to stabilize C channels from turning or twisting C channels 42 are used as the metal floor joists in FIG. 112. The holes 36 are oriented vertically so the reverse lip channel 156 passes through the web 42*a* in a horizontal position, that is the lip notches 126*p* in the reverse lip channel 156 are installed in a horizontal position. On the other hand, when the hole 36 is oriented horizontally the reverse lip channel 156 is oriented vertically so the lips 126*p* are projected vertically. In addition, the reverse lip channel 156 does have to be installed in shorter segments; a coupling can be used to connect two reverse lip channels 156 together. The coupling can be U shaped of a flat plated within the reverse lip channel 156 between the two flanges 156*b* and against the web 156*a*; or another reverse lip channel 156 that has a smaller web 156*a* along with longer lips 156*c* in order to fit within the reverse lip channel 156; or lastly just a reverse lip channel 156 or a U channel 155 that is larger that fits around both of the reverse lip channels 156 needing a coupling 63. The hole 36 in a horizontal position shows the horizontal spacing-bracing channel-passing through the holes 36 of the metal floor joists C channels 42, however the horizontal spacing-bracing channel has notches 126*fg* in the flanges 156*b* that fit into the holes 36 of the metal floor joists. The notches 126*fg* do not extend the full depth of the flange 156*b* so the flange 156*b* has part of the flange 156*b* still connected to the web 156*a*. The flange notches 126*fg* allow the reverse lip channel 156 to extend below the hole bottom edge 36*be* allowing an adjacent reverse lip channel 156 to overlap the lower reverse lip channel 156 at the flange notches 126*fg* and lip notches 126*p*. The flange 156*b* can be cut full depth, but when doing so allows the horizontal spacing-bracing channel can bend easier when placing the horizontal spacing-bracing channel into place. By installing the lip notches 126*p* in the horizontal spacing-bracing channel, the metal floor joists shown as a C channel 42 will not bend or twist easily.

FIG. 89 shows an enlargement of FIG. 88 where three horizontal floor joists are shown a C channels 42 having different size holes and orientations. The shortest floor joist at the front shows two different size holes 36 in the web 42*a* of the C channel 42 also shown in FIGS. 90 & 93. The bottom left hole 36 shows a standard width holes with a reverse lip channel 156 where the web 156*a* is support at the hole bottom edge 36*be* and the lip notches 126*p* are installed inward from the longitudinal outside edges so the hole side edges 36*se* can be installed into the lip notches 126*p*. The front hole 36 shown in the middle and left C channels 42 shows a narrower width hole 36 where the web 156*a* appears shorter and the lips 156*c* are also narrower. The lip notches 126*p* extends the full width of the lip 156*c* and continues about a half of the width of the flange 156*b*. The distance between the back edge of the notches equals the width of the hole 36. The metal framing industry tries to maintain a standardize hole width, however the hole width comes in three sizes and the key hole is also used as another width size. So the standard U channel 155 does vary in width and so will the reverse lip channel 156 vary in width at the web, flanges and lips including the length of the lip notches 126*p* and flange notches 126*fg* or any other notches used to connect into the hole. The various widths of the webs at a reverse lip channel 156 can have the longitudinal ends of two adjoining reverse lip channels 156 having different widths, therefore the longitudinal ends of a connecting reverse lip channel 156 or a coupling 63 can have two different sizes at each longitudinal end.

Figure 90:
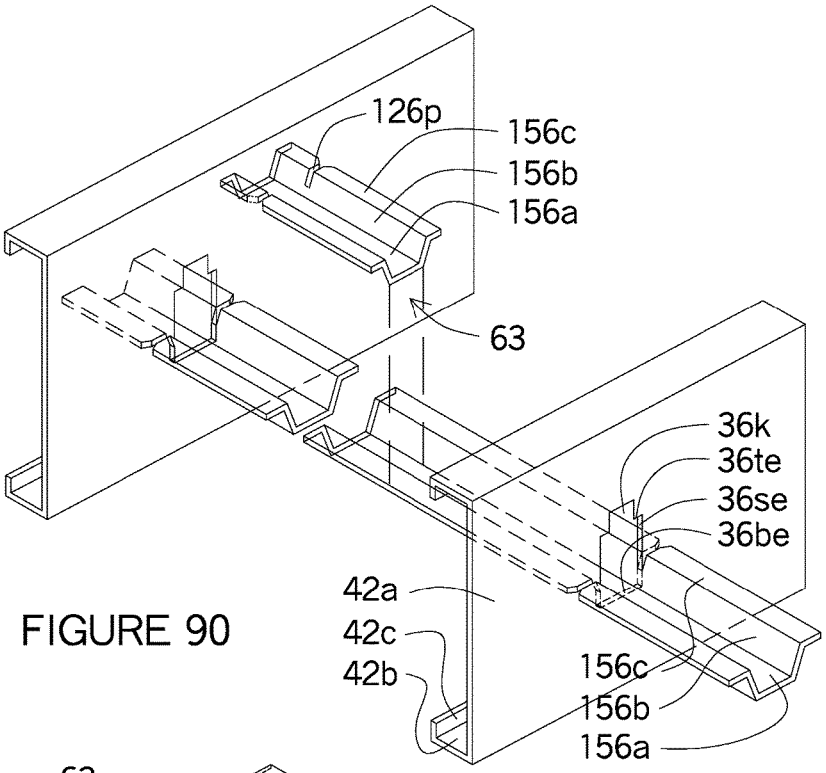
FIG. 90 shows a narrow width hole where the lips notches 126*p* and the flange notches 126*fg* extend into the hole side edges along with a coupling or smaller width horizontal spacing-bracing member also having notches connecting two adjacent reverse lip spacer channels.
Figure 91:
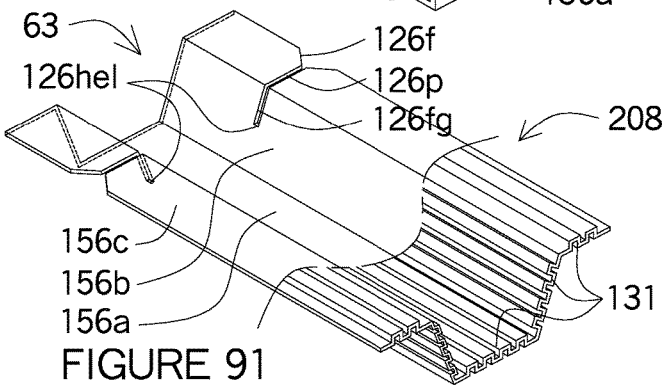
FIG. 91 shows a smaller width reverse lip spacer channel having the lip notches and flange notches used as a coupling, bracket and or from a cut off reverse lip spacer brace. The drawing is larger so the grooves are more noticeable.

In FIG. 90 two adjacent longitudinal spacing-bracing channels are shown end to end passing through a smaller width hole 36. The smaller width hole requires a longer notch using the full depth of the lip 156*c* and a portion of the flange 156*b* in order to increase the horizontal resistance created by a wind force and possibly increasing the gauge of the metal to reduce the horizontal wind force or distribute the vertical load from weight of the building structure. When the reverse lip channel 156 has lip notches 126*p* and angle flanges 156*b* plus flange notches 126*fg* extending into the angled flanges 156*b*, the end of the flange notches 126*fg* are shown as heel notches 126*hel* wherein distance between the heel notches 126*hel* on one flange and the distance between the heel notch 126*hel* on the opposing flange 156*b* is the width of the hole 36 in the support member. There are many obvious solutions a Structural Engineer would use including: a smaller reverse lip channel 156 that fits at the interior between the flanges; underneath the two reverse lip channels 156 outside around the flanges 156*b*; install one lip notch 126*p* into a hole 36 at one end and the opposing end attached to the adjacent reverse lip channel 156; install a multisided bracket at each hole; or just install another reverse lip channel 156 with lip notches 126*p* between the two support members. Also when the reverse lip channel 136 has flange notches 126*fg* along with lip notches 126*p* the angular oriented flanges 136*b* will engage the hole bottom edge 36*be* and assuming the adjacent reverse lip channel 136 is stacked above connecting the same hole 36 the lower reverse lip channel 136 having the same profile but the lip 156*c* only has lip notches 126*p* the upper reverse lip channel will have its lips 156*c* resting on the hole bottom edge with its lips extending horizontal at the same plane of the hole bottom edge 36*be*. So by having flange notches 126*fg* the first reverse lip channel 156 is set lower at the hole bottom edge 36*be* than the second reverse lip channel having its lips 156*c* resting on the hole bottom edge 36*be*. FIG. 91 shows an enlargement of a coupling 63 or an enlargement of the reverse lip channel 156, but also shows grooves 131 installed at the web 156*a*, flanges 156*b* and lips 156*c* for additional lateral strength. A longer reverse lip channel 156 with notches 126*p* or 126*fg* could just to cut at the job site to just fit any particular size. The grooves 131 extending longitudinally the full length of the reverse lip channel 156 and being interrupted with lip notches 126*p* and flange notches 126*fg* typically spaced 16 or 24 inch spacing with the notches indented from the ends in order to overlap the adjacent longitudinal spacing-bracing channels. When the reverse lip channel 156 has the lips notches 126*p* and flanges notches 126*fq* facing downward the flange notches 126*fg* engage the hole bottom edge 36*be* of the reverse lip channel 156, on the other hand when the reverse lip channel 156 is facing upward the flange notches 126*fg* will engage the hole side edges 36*se*.

Figure 92:
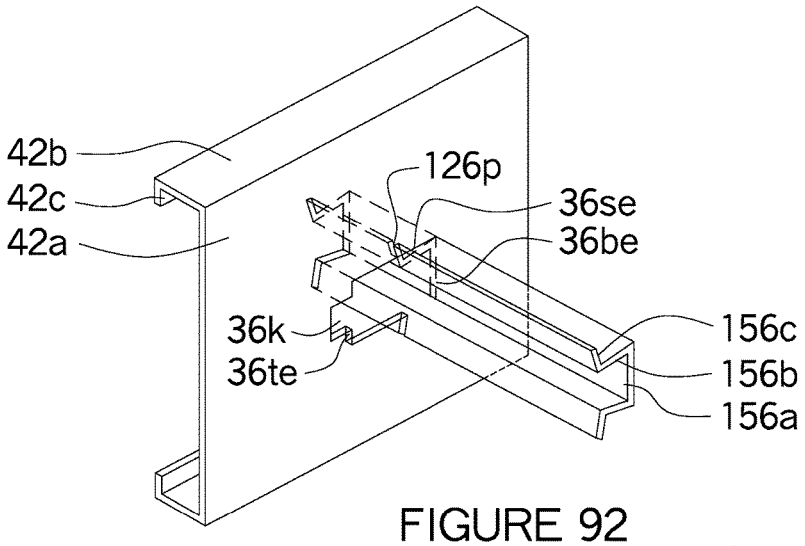
FIG. 92 shows the longitudinal reverse lip channel showing the lips with the lip notches extending into the top and bottom edges of the hole, but still referred as the holes side edges.
Figure 93:
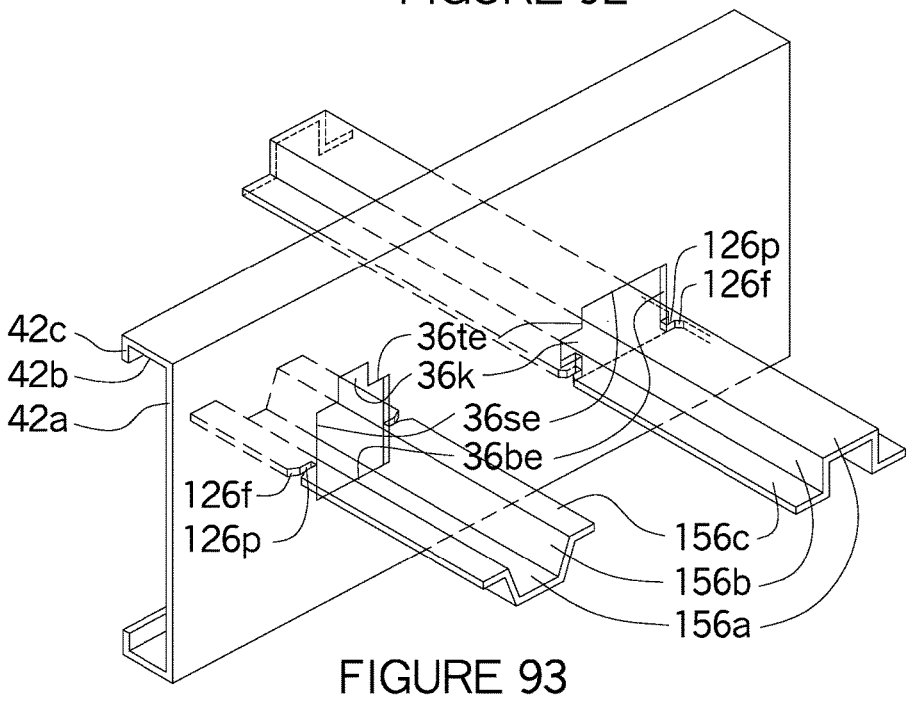
FIG. 93 shows a wider hole that shows a wider web of the longitudinal spacing-bracing channel. On the other hand another longitudinal spacing-bracing channel shows a wider web and wider lips so the lip notches can fit into the hole top edge and the hole bottom edge as the reverse lip channel has its lip resting on the hole side edges.

In FIGS. 89, 92 & 93 show the other three holes 36 oriented horizontally that is the width is the vertical dimension and the length in the horizontal direction including the depth of the grooves and the gauge of the metal framing members. One hole shows the reverse lip channel 156 where the lip notches 126*p* extend into the hole top edges and the hole bottom edges 36*be*. The left C channel 42 shows the reverse lip channel installed vertically where the lip notches 126*p* extend into the hole side edge 36*se* as shown in FIG. 92.

The present invention among other things is directed to different types of wall forming supports, longitudinal spacing-bracing members and C channel support channels with different shaped holes which receive longitudinal spacing-bracing members and longitudinal horizontal members with tie-downs. Spacer blocks with tongues and grooves can be used between the wall forming supports interlocking the spacer blocks together within the formed wall. The tongues and grooves of the spacer blocks interlock the spacer blocks together and with the wall forming supports.

Various types of longitudinal spacing-bracing members interlock through distinctive holes in the web of the support members described above by having notches in the joined corner of the web and flanges of the longitudinal spacing-bracing members, or notches and optionally flares at the lips of the longitudinal spacing-bracing members; or notches at the vertex of the V-shaped of longitudinal spacing-bracing members. The holes in the web are adapted to receive particular longitudinal spacing-bracing members as described above. Thus the present invention engages the holes in the web of the support members in a unique an innovative way spacing, connecting and interlocking the longitudinal spacing-bracing members and the support members together.

The longitudinal spacing-bracing members can be connected together with a U-shaped coupling by securing larger or smaller U channels to the ends of similar longitudinal spacing-bracing members having similar cross-sectional shapes to make two or more longitudinal spacing-bracing members.

The horizontal bracing channels can be connected to the holes in the support channels by engaging the notches in the lips of the coupling or multi-plane brackets and connecting the webs of the horizontal bracing channels and the multi-plane brackets together.

It is understood that the invention is not to be limited to the exact details of operation or structures shown and describing in the specification and drawings, since obvious modifications and equivalents of the described invention will be readily apparent to those skilled in the art. The flexibility of the described invention is very versatile and can be used in many different types of building applications.

TABLE OF CONTENTS

20 column mold 20,
36 hole 36, 36*c*-round hole, 36*rt*-rectilinear hole, 36*o*-oblong hole, 36*v*-V-shaped hole, 36'-hole, 36*p*-punched holes, 36*r*-rim, 36"-V-shaped hole
37 fastener
39 concrete,
41 U channel,
42 C channel, 42*a*-web, 42*b*-flanges, 42*c*-lips, 42*i*-indentation
45 gap
50 rigid board
51 rigid insulation
55 foam spacer, 55*t*-horizontal tongue, 55*vp* vertical projection, 55*s*-short foam spacer, 55*b*-groove shape, 55*p*-projection, 55*t*-tongue, 55*a*-tongue shape 63 coupling, 63'-coupling
64 connectors
70 hat channel
72 wood blocking
78 diagonal bracing
79 ledges
88 rigid foam block faces
90 beam mold
96 ICF block molds
99 base plate angle
100 insulating foam
105 double flange channel, 105*a*-web, 105*b*-flange, 105*b*'-flange, 105*b*"-flanges, 105*b*'"-flange
111 structural insulating core
120 base plate, 120*a*-web, 120*b*-flange, 120*b*"-flange
121 groove:
122 screw
123 double headed fastener
124 rib
126 & 126' notch, 126*p*-lip notches, 126*vf*-vertical-flange notches, 126*vg*-V-leg notches, 126*c*-corner notches, 126*fg*-flange notches, 126*ap*-angular lip notch, 126*w*-web notch, 126*f*-flare edge
132 trough
138 multi-plane bracket,
151 drainage channels
155 & 155' horizontal U channel, 155*a* & 155*a*'-web, 155*b* & 155*b*'-flanges
156 horizontal reverse lip channel, 156*a*-web, 156*b*-flange, 156*c*-lip, 156*r*-ribs
157 horizontal V channel
159 blunt end
166 round rod
167 hollow tube,
168 small ridges
169 punched holes
175 floor
180 precast mold
208 reverse lip bracket, 208*a*-web, 208*b*-flanges, 208*c*-lips
242 mortar

The invention claimed is:

1. A structural framing system, comprising:

a first longitudinal spacing-bracing member comprising a web lying in a plane, said web having a first side and a second side opposite said first side, a first longitudinal wall connected to said first side of said web and a second longitudinal wall connected to said second side of said web;

said web, said first longitudinal wall and said second longitudinal wall forming a channel, a first lip connected to an edge of said first longitudinal wall distal with respect to said web, a second lip connected to an edge of said second longitudinal wall distal with respect to said web, said first lip and said second lip extending in substantially opposite directions, said first lip and said second lip each comprising a plurality of notches spaced along a longitudinal length of said spacing-bracing member, said notches extending toward a longitudinal axis of said web;

a first structural member and a second structural member substantially identical to said first structural member, each said structural member having a web and flanges, each said structural member having an aperture extending through said respective webs, said apertures being defined by a perimeter, whereby said notches are configured to engage a respective one of said perimeters forming a connection among said longitudinal spacing-bracing member, said first structural member and said second structural member;

whereby said first longitudinal spacing-bracing member is configured to be connected to a second substantially identical longitudinal spacing-bracing member by a U-shaped bracket configured to nest within said channel of said first longitudinal spacing-bracing member and a channel of said second longitudinal spacing-bracing member, said U-shaped bracket having opposed lips with notches configured to receive a respective one of said perimeters of said respective apertures.

2. The structural framing system of claim 1, further comprising a second spacing bracing member having a web, a first flange and a second flange each connected to said web of said second spacing bracing member, a first lip and a second lip, and a notch at a free distal edge of each of said respective lips, said web of said second spacing bracing member being wider than said first spacing bracing member to permit said first spacing bracing member to nest within said second spacing bracing member, whereby said notches of said second spacing bracing member are configured to engage said respective one of said perimeters.

3. Me structural framing system of claim 1, wherein an end portion of said web of said second longitudinal spacing-bracing member extends over an end portion of said first longitudinal spacing-bracing member by overlapping.

4. The structural framing system of claim 1, wherein the notches of said first longitudinal spacing-bracing member engage one of the respective perimeters of said respective apertures.

5. The structural framing system of claim 1, wherein the respective notches extend from said respective lips and terminate at a juncture of said web and a respective said longitudinal wall.

6. The structural framing system of claim 1, wherein said notches have a flared portion on at least one respective side edge of said lips.

* * * * *